US010465468B2

(12) United States Patent
Frazier et al.

(10) Patent No.: US 10,465,468 B2
(45) **Date of Patent: *Nov. 5, 2019**

(54) DOWNHOLE TOOLS HAVING NON-TOXIC DEGRADABLE ELEMENTS

(71) Applicant: MAGNUM OIL TOOLS INTERNATIONAL, LTD., Corpus Christi, TX (US)

(72) Inventors: W. Lynn Frazier, Corpus Christi, TX (US); Garrett Frazier, Corpus Christi, TX (US); Derrick Frazier, Corpus Christi, TX (US)

(73) Assignee: Magnum Oil Tools International, Ltd., Corpus Christi, TX (US)

( * ) Notice: Subject to any disclaimer, the term of this patent is extended or adjusted under 35 U.S.C. 154(b) by 305 days.

This patent is subject to a terminal disclaimer.

(21) Appl. No.: 15/355,346

(22) Filed: Nov. 18, 2016

(65) Prior Publication Data

US 2017/0067312 A1 Mar. 9, 2017

Related U.S. Application Data

(63) Continuation-in-part of application No. 15/189,090, filed on Jun. 22, 2016, now Pat. No. 10,352,125, and (Continued)

(51) Int. Cl.

| | |
|---|---|
| ***E21B 33/124*** | (2006.01) |
| ***E21B 43/26*** | (2006.01) |
| ***E21B 33/12*** | (2006.01) |
| ***E21B 33/129*** | (2006.01) |
| ***E21B 34/06*** | (2006.01) |

(Continued)

(52) U.S. Cl.

CPC ..... *E21B 33/1208* (2013.01); *E21B 33/12* (2013.01); *E21B 33/129* (2013.01); *E21B 33/1293* (2013.01); *E21B 34/063* (2013.01); *E21B 43/11* (2013.01); *E21B 43/26* (2013.01); *E21B 2034/005* (2013.01)

(58) Field of Classification Search

CPC .... E21B 33/1208; E21B 33/124; E21B 43/26; E21B 34/063; E21B 2034/002

See application file for complete search history.

(56) References Cited

U.S. PATENT DOCUMENTS

| | | | |
|---|---|---|---|
| 4,655,247 | A | 4/1987 | Westra et al. |
| 7,093,664 | B2 | 8/2006 | Todd et al. |

(Continued)

FOREIGN PATENT DOCUMENTS

| | | |
|---|---|---|
| JP | 2013183363 | 12/2013 |
| WO | 2014109347 | 7/2014 |

OTHER PUBLICATIONS

PCT/JP2015/076150, International Preliminary Report and Written Opinion, 9 pages dated Apr. 6, 2017.

*Primary Examiner* — Catherine Loikith

(74) *Attorney, Agent, or Firm* — Jackson Walker LLP

(57) ABSTRACT

Downhole tools for use in oil and gas production which degrade into non-toxic materials, a method of making them and methods of using them. A frac ball and a bridge plug comprised of polyglycolic acid which can be used in fracking a well and then left in the well bore to predictably, quickly, and safely disintegrate into environmentally friendly products without needing to be milled out or retrieved.

23 Claims, 23 Drawing Sheets

Related U.S. Application Data a continuation of application No. 14/132,608, filed on Dec. 18, 2013, now Pat. No. 9,500,061, which is a continuation-in-part of application No. 13/969,066, filed on Aug. 16, 2013, now Pat. No. 9,506,309, which is a continuation-in-part of application No. 13/895,707, filed on May 16, 2013, now Pat. No. 9,587,475, which is a continuation-in-part of application No. 13/894,649, filed on May 15, 2013, now Pat. No. 9,217,319, which is a continuation of application No. 13/843,051, filed on Mar. 15, 2013, now abandoned, said application No. 15/355,346 is a continuation-in-part of application No. 12/317,497, filed on Dec. 23, 2008, now Pat. No. 8,496,052.

(60) Provisional application No. 62/406,195, filed on Oct. 10, 2016, provisional application No. 62/374,454, filed on Aug. 12, 2016, provisional application No. 62/372,550, filed on Aug. 9, 2016, provisional application No. 61/738,519, filed on Dec. 18, 2012, provisional application No. 61/648,749, filed on May 18, 2012.

(51) Int. Cl.
*E21B 43/11* (2006.01)
*E21B 34/00* (2006.01)

(56) References Cited

U.S. PATENT DOCUMENTS

| | | | | |
|---|---|---|---|---|
| 7,775,278 | B2 * | 8/2010 | Willberg | C09K 8/508 166/280.1 |
| 9,267,351 | B2 | 2/2016 | Okura et al. | |
| 2009/0255686 | A1 | 10/2009 | Richard et al. | |
| 2011/0048743 | A1 | 3/2011 | Stafford et al. | |
| 2011/0056677 | A1 | 3/2011 | Holderman et al. | |
| 2011/0067889 | A1 | 3/2011 | Marya et al. | |
| 2012/0073819 | A1 * | 3/2012 | Richard | E21B 33/10 166/308.1 |
| 2012/0181032 | A1 | 7/2012 | Naedler et al. | |
| 2013/0043041 | A1 | 2/2013 | McCoy et al. | |
| 2013/0048305 | A1 | 2/2013 | Xu et al. | |
| 2013/0081801 | A1 | 4/2013 | Liang et al. | |
| 2013/0118759 | A1 | 5/2013 | Crews | |
| 2013/0199800 | A1 | 8/2013 | Kellner et al. | |
| 2014/0014339 | A1 | 1/2014 | O/Malley et al. | |
| 2015/0096741 | A1 | 4/2015 | Okura et al. | |
| 2017/0175481 | A1 | 6/2017 | Kobayashi et al. | |
| 2017/0218720 | A1 | 8/2017 | Takahashi et al. | |
| 2017/0268307 | A1 | 9/2017 | Cooke | |
| 2017/0284167 | A1 | 10/2017 | Takahashi et al. | |

* cited by examiner

BALL DEGRADATION RATE

| INPUT | |
|---|---|
| TEMPERATURE °F | 275° F |
| INITIAL BALL OD | 3.000in |
| BALL SEAT ID | 2.200in |

| OUTPUT | |
|---|---|
| DEGRADATION RATE (IN/HR) | -0.03304 in/hr |
| TIME TO DEGRADE TO BALL SEAT ID | 12.11 hrs |

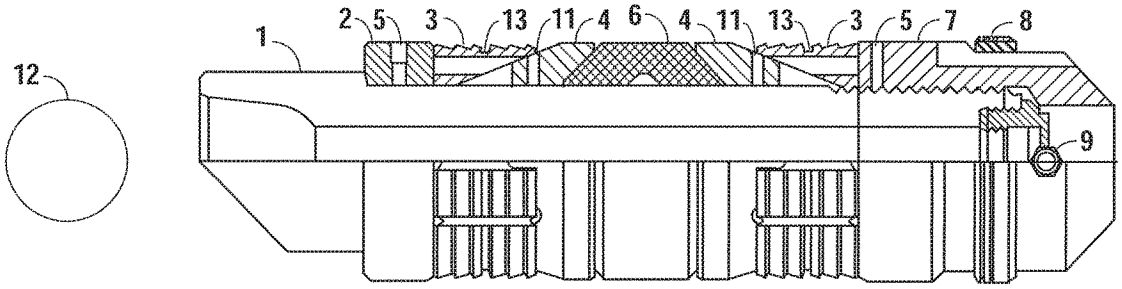

SNUB NOSE, BALL DROP, 5-1/2, 15.5-20.0#, 6K, 250F, Ø4.300"

| ITEM NO. | QUANTITY | DESCRIPTION |
|---|---|---|
| 1 | 1 | MANDREL, 5-1/2", SNUB NOSE SERIES |
| 2 | 1 | LOAD RING, 5-1/2", RAPID MILL |
| 3 | 2 | SLIP SECTION, 5-1/2" |
| 4 | 2 | CONE, 5-1/2", SNUB NOSE SERIES |
| 5 | 4 | 1/4-20 X 3/8" SET SCREW,SOCKET HEAD CAP, CUP POINT, STEEL |
| 6 | 1 | CENTER ELEMENT, 5-1/2" |
| 7A | 1 | BOTTOM 5-1/2", SNUB NOSE SERIES |
| 7B | 1 | BOTTOM, DUMMY, 5-1/2", SNUB NOSE SERIES (OPTIONAL) |
| 8 | 1 | PUMP DOWN ELEMENT, RAPID MILL, 5-1/2", (OPTIONAL) |
| 9 | 2 | 3/8-16 X 1/2 "ALUMINUM BOLT (OPTIONAL) |
| 10 | 1 | SHEAR SUB INSERT, 5-1/2" |
| 11 | 8 | 1/4-20 X 3/4" SET SCREW, SOCKET HEAD CAP, CUP POINT, STEEL |
| 12 | 1 | G-10 COMPOSITE BALL BEARING, 1-3/4" |
| 13 | 2 | SLIP WIRE,RETAINER, 4-1/2" THRU 5-1/2" |
| 14 | 1 | TORSION SPRING, 4-1/2", F / BAKER 10 |
| 15 | 1 | TORSION SPRING, 5-1/2", F / BAKER 20 |

Fig. 19

DOWNHOLE TOOLS HAVING NON-TOXIC DEGRADABLE ELEMENTS

CROSS REFERENCE TO RELATED APPLICATIONS

This application claims priority to U.S. patent application Ser. No. 14/132,608, filed Dec. 18, 2013; U.S. patent application Ser. No. 13/969,066, filed Aug. 16, 2013, which is a continuation-in-part of U.S. patent application Ser. No. 13/895,707, filed May 23, 2013; U.S. Pat. No. 9,217,319, issued Dec. 22, 2015, which is a continuation of and claims priority to U.S. patent application Ser. No. 13/843,051, filed Mar. 15, 2013; and which claims the benefit of U.S. Provisional Application 61/648,749, filed May 18, 2012; U.S. Provisional Application 61/738,519, filed Dec. 18, 2012; U.S. Pat. No. 8,496,052, issued Jul. 30, 2013; U.S. Provisional Application 62/372,550, filed Aug. 9, 2016; U.S. Provisional Application 62/374,454, filed Aug. 12, 2016; U.S. Provisional Application 62/406,195, filed Oct. 10, 2016; and U.S. patent application Ser. No. 15/189,090, filed Jun. 22, 2016, are incorporated herein by reference.

U.S. Pat. No. 6,951,956 is also incorporated herein by reference.

BACKGROUND OF THE INVENTION

This specification relates to the field of mineral and hydrocarbon recovery, and more particularly to the use of high-molecular weight polyglycolic acid as a primary structural member for a degradable oilfield tool.

It is well known in the art that certain geological formations have hydrocarbons, including oil and natural gas, trapped inside of them that are not efficiently recoverable in their native form. Hydraulic fracturing ("fracking" for short) is a process used to fracture and partially collapse structures so that economic quantities of minerals and hydrocarbons can be recovered. The formation may be divided into zones, which are sequentially isolated, exposed, and fractured. Fracking fluid is driven into the formation, causing additional fractures and permitting hydrocarbons to flow freely out of the formation.

It is also known to create pilot perforations and pump acid or other fluid through the pilot perforations into the formation, thereby allowing the hydrocarbons to migrate to the larger formed fractures or fissure.

To frac multiple zones, untreated zones must be isolated from already treated zones so that hydraulic pressure fractures the new zones instead of merely disrupting the already-fracked zones. There are many known methods for isolating zones, including the use of a frac sleeve, which includes a mechanically-actuated sliding sleeve engaged by a ball seat. A plurality of frac sleeves may be inserted into the well. The frac sleeves may have progressively smaller ball seats. The smallest frac ball is inserted first, passing through all but the last frac sleeve, where it seats. Applied pressure from the surface causes the frac ball to press against the ball seat, which mechanically engages a sliding sleeve. The pressure causes the sleeve to mechanically shift, opening a plurality of frac ports and exposing the formation. High-pressure fracking fluid is injected from the surface, forcing the frac fluid into the formation, and the zone is fracked.

After that zone is fracked, the second-smallest frac ball is pumped into the well bore, and seats in the penultimate sleeve. That zone is fracked, and the process is continued with increasingly larger frac balls, the largest ball being inserted last. After all zones are fracked, the pump down back pressure may move frac balls off seat, so that hydrocarbons can flow to the surface. In some cases, it is necessary to mill out the frac ball and ball seat, for example if back pressure is insufficient or if the ball was deformed by the applied pressure.

Another style of frac ball can be pumped to a different style of ball seat, engaging sliding sleeves. The sliding sleeves open as pressure is increased, causing the sleeves to overcome a shearing mechanism, sliding the sleeve open, in turn exposing ports or slots behind the sleeves. This permits the ports or slots to act as a conduit into the formation for hydraulic fracturing, acidizing or stimulating the formation.

It is known in the prior art to manufacture frac balls out of carbon, composites, metals, and synthetic materials such as nylon. When the frac ball has fulfilled its purpose, it must either be removed through fluid flow of the well, or it must be destructively drilled out. Baker Hughes is also known to provide a frac ball constructed of a nanocomposite material known as "In-Tallic." In-Tallic balls are advertised to begin dissolving within 100 hours in a potassium chloride solution.

In some embodiments, Applicants describe structural elements as being degradable and being homogenous and/or non-composite. Homogenous and non-composite mean that the structural element does not contain a mixture of two or more different materials. It means that the structural element is not a mixture of physically discrete or chemically discrete components, and that it has a substantially uniform texture throughout. It is not layered; it does not combine resin and fibers, even if they are the same chemical compound. The rate of degradation is the same throughout, it does not contain material that has a first rate of degradation with a material that has a second rate of degradation. A component may be degradable and homogenous where it is made entirely of a single composition, such as polyglycolic acid, that may be a part chrystalline and part amorphous.

Another style of frac ball can be pumped to a different style of ball seat, engaging sliding sleeves. The sliding sleeves open as pressure is increased, causing the sleeves to overcome a shearing mechanism, sliding the sleeve open, in turn exposing ports or slots behind the sleeves. This permits the ports or slots to act as a conduit into the formation for hydraulic fracturing, acidizing or stimulating the formation.

SUMMARY OF THE INVENTION

In one exemplary embodiment, a plurality of mechanical tools for down hole use are described, each comprising substantial structural elements made with high molecular weight polyglycolic acid (PGA). The PGA of the present disclosure is hard, millable, substantially incompressible, homogenous, and capable of being used as the material of downhole tools. The PGA material of the present disclosure begins to lose structure above about 136° F. in fluid. Under a preferable thermal stress of at least approximately 250° F. the PGA material substantially loses its structure within approximately 48 hours. As the structure breaks down, the PGA tools lose compression resistance and structural integrity. After the structure breaks down, the remaining material can be safely left to biodegrade over a period of several months. The products of biodegradation, are substantially glycine, carbon dioxide, and water, and are non-toxic to humans. PGA tools provide the advantage of being usable downhole and then, when their function is accomplished, removed from the well bore through passive degradation rather than active disposal. The disclosed downhole tools made of PGA material can be initially used as conventional downhole tools to accomplish conventional downhole tool tasks. Then, upon being subjected to downhole fluids at the described temperatures, for the described times, the PGA elements lose (1) compression resistance and structural integrity which causes them to cease providing their conventional downhole tool tasks, followed by (2) passive degradation into environmentally-friendly materials. This permits them to be left in the well bore rather than having to be milled out or retrieved. Other benefits and functions are disclosed.

In another embodiment, a method of producing hydrocarbons from multiple zones from a well is provided, the well having a wellbore with a wellbore casing, the method comprising the following steps. Providing a first set of frac plugs, each with an inner conduit, adapted to fit within the wellbore casing, and a first set of frac balls, each frac ball adapted to fit within one of the provided frac plugs and to block the frac plug's inner conduit, wherein at least one of either the frac ball or the frac plug in each frac plug and frac ball combination is comprised of a homogenous, non-metallic, degradable material that will begin to degrade in a fluid at a temperature of at least above about 150° F. within about one month of being exposed to downhole fluid in the casing, resulting in a sufficient loss in mass that the frac plug and frac ball combination ceases to isolate zones. The method includes perforating the casing and fracing a first lower zone; running a bottom hole assembly comprising at least a first frac plug and a setting tool into the casing to a first setting depth and setting the first plug at a first setting depth in the lower zone; inserting a first ball down the casing until it seats within the first plug and seals its inner conduit, isolating the first lower zone, then perforating the casing at a second lower zone above the first set frac plug and fracing the second lower zone. The method repeats the running, setting, inserting, seating, sealing, and isolating steps above the second lower zone with an additional frac plug and frac ball from the first set of degradable frac plug and frac ball combinations. The wellbore within the lower zone in one embodiment has fluid at a temperature of at least about 150° F. and the first set of frac plugs in the lower zone are not drilled out, but rather degrade within about one month of being exposed to the downhole fluid in the wellbore casing resulting in a sufficient loss in mass that each frac plug and frac ball combination therein ceases to isolate zones.

In another embodiment, Applicants provide a downhole tool for engaging a wellbore casing of a hydrocarbon well, the downhole tool comprising structural elements including a cylindrical mandrel having an outer surface and an inner surface, the inner surface defining an inner conduit, and also structural elements disposed on the outer surface of the mandrel, at least some configured to engage the inner walls of the wellbore casing in a set position and some others to drive those configured to set into the set position from a run in position. At least some of the structural elements comprise a non-composite degradable material that will begin degradation at fluid temperatures above about 150° F. and will degrade into environmentally harmless products.

In another embodiment, Applicants provide a device for use in a well comprising a borehole extending from a surface location and penetrating a hydrocarbon bearing interval and with a casing string in the borehole having a minimum internal diameter. The device may comprise a flapper valve assembly and a tubular housing with an inner diameter, providing part of the casing string and being at a location between the hydrocarbon bearing interval and the surface location. A flapper valve engages the tubular housing and is moveable between a first operative position allowing upward and downward flow through a casing string and tubular housing and a second operative position allowing upward flow and preventing downward flow through the casing and tubular housing, the flapper valve member being substantially homogenous, nonmetallic and comprised of a degradable material, degradable in acidic or non-acidic fluids at temperatures above about 150° F.

In another embodiment, Applicants provide a method of temporarily plugging a section of casing at a well at a well site with degradable frac balls, including providing a set of polyglycolic acid ("PGA") frac balls to the well site. The balls in the set of balls have preselected diameters, at least some of the balls have preselected constant incremental diameter differences. The ball diameters of the balls in the set of balls are selected through use of ball degradation rate factors, and estimated formation conditions in the well, so at least some of the balls within the set of balls are appropriate for temporarily plugging a first frac plug and a second frac plug within the section of casing at the well. The steps include determining a location in the well for positioning the first frac plug and determining a location in the well for the second frac plug, the second frac plug being located above the first frac plug. One may estimate formation conditions at the location for positioning the first frac plug in the well; including at least formation temperature, and determine a desired duration for the first frac plug to be plugged. One may estimate formation conditions at the location for positioning the second frac plug in the well, including at least formation temperature, and determine a desired duration for the second frac plug to be plugged. The steps include determining appropriate ball size for a first frac plug seat size and appropriate ball size for a second frac plug seat size using PGA ball degradation rate factors, and well conditions at the first and second frac plugs, and the desired duration for the first and second frac plugs to be plugged. A first frac ball for the first frac plug should provide sufficient overlap to withstand the estimated maximum pressure. One may insert the first frac ball into the well casing, pumping the first frac ball down the well until its seats with the first frac plug, perforate, and frac the zone, then set, plug, perforate, and frac high zones.

Applicants provide an assembly for use in at least two downhole isolation valves in production operations in a well, comprising a set of homogenous, non-metallic degradable frac balls, the balls in the set of balls having preselected diameters, at least some of the balls having preselected constant incremental diameter differences, the ball diameters of the balls in the set of balls being selected through use of ball degradation rate factors and estimated formation conditions at the downhole isolation valves, so at least some of the balls within the set of balls are appropriate for temporarily plugging a first isolation valve and a second isolation valve within the well.

Applicants further provide a sub for use downhole in a hydrocarbon well, the sub comprising at least one disk having a body and a perimeter; and a support structure having an inner conduit, the support structure for engaging the at least one disk at the perimeter of the disk. wherein the disk is dimensioned in an initial condition to block the inner conduit within the support structure, the disk comprised of a homogenous, non-metallic, degradable material, which is capable of degrading in downhole fluid.

Applicants further provide a device for setting a downhole tool against the inner diameter of a downhole casing of a well. The device may comprise a cylindrical slip having an outer section comprised of teeth and an inner section comprised of an inner wall, wherein the teeth are comprised of a metallic material. At least part of the inner walls are comprised of a non-metallic, homogenous, degradable material that will begin to degrade when exposed to a downhole fluid at a temperature of at least at about 150° F. so that when used in well with downhole fluid at a temperature of at least 150° F., the inner walls detach from the teeth and degrade into smaller fragments within a predetermined time which do not substantially interfere with completing the well.

Applicants further provide an isolation sub for use in subterranean hydrocarbon recovery comprising: a rigid casing configured to interface with a casing string or tubing string; and a plurality of ports disposed along the circumference of the rigid casing, each port having seated therein a retaining plug, each retaining plug having seated therein a plug consisting essentially of a degradable material, such as polyglycolic acid.

In addition, Applicants provide multiple settable downhole tools, with setting elements engaging a mandrel, the mandrel defining an inner conduit and supporting a seat; a non-composite body is configured to engage the seat in an initial configuration. The non-composite body is substantially stable in a dry condition at ambient temperature, and, when exposed to a downhole fluid having a temperature of at least about 136° F., the non-composite body will change to a subsequent configuration that does not engage the seat. In its changed configuration, it is then capable of passing through the seat and inner conduit. The non-composite body, in one embodiment, is prepared from polyglycolic acid (PGA). The non-composite body may be spherical, and is in the range of between about 0.750 inches to about 4.625 inches in diameter. The non-composite body may be homogenous; and will degrade into environmentally non-toxic substances within up to about one month of being exposed to the downhole fluid.

BRIEF DESCRIPTION OF THE DRAWINGS

FIG. 19 is a side elevational view; partially cut away of a 5½ inch snub nose ball drop with items designated numbers 1 through 15 for that Figure only.

FIG. 24B in an up or opened position.

DETAILED DESCRIPTION OF THE EMBODIMENTS

Figure 1:
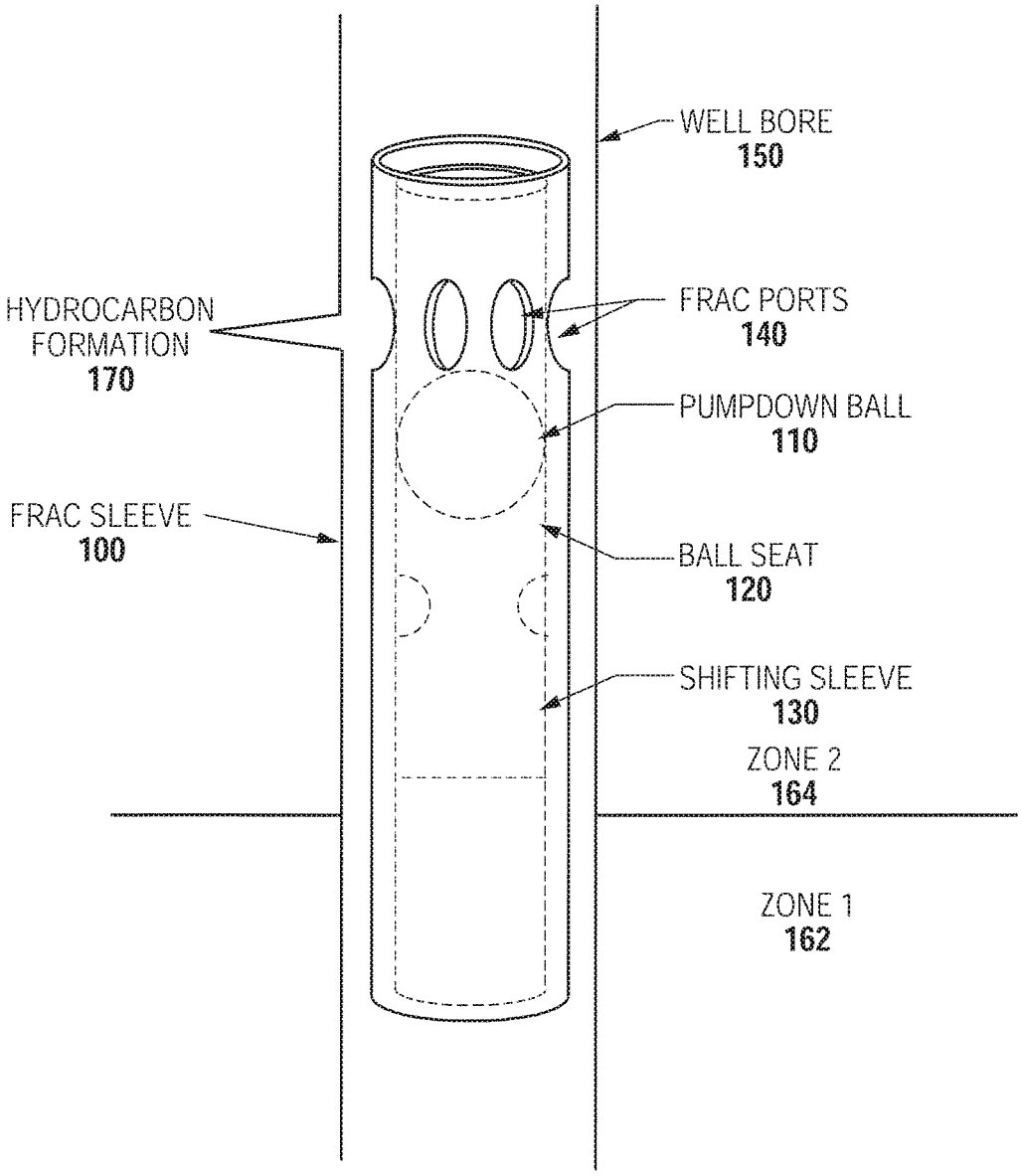
FIG. 1 is a cutaway side view of a frac sleeve actuated with a PGA frac ball.

One concern in the use of frac balls in production operations is that the balls themselves can become problematic. Because it is impossible to see what is going on in a well, if something goes wrong, it is difficult to know exactly what has gone wrong. It is suspected that prior art frac balls can sometimes become jammed, deformed, or that they can otherwise obstruct hydrocarbon flow when such obstruction is not desired.

One known solution to the problem of frac balls obstructing flow when obstruction is not desired is to mill out the prior art frac balls and the ball seats. But milling is expensive and takes time away from production. Baker Hughes has introduced a nanocomposite frac ball called In-Tallic.® In-Tallic® balls will begin to degrade within about 100 hours of insertion into the well, in the presence of potassium chloride.

Polyglycolic (PGA) acid is a polyester of glycolic acid. PGA has been shown to have excellent short-term stability in ambient conditions. Kuredux®, and in particular Kuredux® grade 100R60, is a biodegradable PGA with excellent mechanical properties and processability. Frazier, et al. have identified a method of processing Kuredux® PGA resin into mechanical tools for downhole drilling applications, for example for hydrocarbon and mineral recovery and structures and methods for using them.

The Applicant has made and tested PGA frac balls of the present disclosure by leaving them in room temperature tap water for months at a time. After two months, the PGA frac balls showed no signs of substantial degradation or structural changes. Applicant's PGA frac balls show no appreciable sign of degradation in ambient moisture and temperature conditions over a period of at least one year.

In one test of an exemplary embodiment, a 3.375-inch PGA frac ball withstood about 6,633 psi before structural failure. A 2.12-inch frac ball withstood 14,189 psi before failing. A 1.5-inch in frac ball withstood at least 15,000 psi for 15 minutes without failing. A failure point of the 1.5-inch frac ball was not reached because the test rig was not able to exceed 15,000 psi. Thus, a PGA frac ball is suitable for high pressure downhole hydrocarbon recovery operations, typically frac operations.

PGA frac balls can be pumped down a well bore from the surface. Typically, the initial pumping fluid is approximately 50 to 75° Fahrenheit, which condition does not have any appreciable effect on the short-term structural integrity of the frac ball. Bottom hole temperatures are known to increase with depth, as shown, for example, in FIG. 3 of Comprehensive Database of Wellbore Temperatures and Drilling Mud Weight Pressures by Depth for Judge Digby Field, La., Open-File Report 2010-1303, U.S. Department of the Interior, U.S. Geological Survey. The Department of Interior FIG. 3 chart is incorporated by reference and shows a relatively linear line temperature vs. depth relationship from about 75° F. at about 4,500 feet to about 400° F. at about 24,000 feet. South Texas oil wells typically have depths from about 5,000 to 11,000 feet. When fracking operations commence, however, the higher fracking pressures cause the temperature of the downhole fluid to rise dramatically. The PGA frac ball performs as a conventional frac ball, sealing against the bridge plug seat to block the well bore. When fracking operations commence, however, the higher fracking pressures cause the temperature of the downhole fluid to rise dramatically. Downhole production fluid temperatures of South Texas wells typically range from 250° F. to 400° F. Temperature ranges vary around the world, in different formations, conditions, and procedures and thus may be higher or lower at other locations and conditions and procedures. Once the PGA frac ball is exposed to the higher temperature and pressure conditions of the fracking operation, it first continues to function as a conventional frac ball, sealing against the bridge plug's seat to block the fracking operation while it begins to lose its structural integrity. Sufficient structural integrity is maintained during the fracking operation for the PGA frac ball to continue to function as a conventional frac ball. After the fracking operation ends, the PGA frac ball deteriorates, loses its structural integrity, passes through the bridge plug seat, and ceases to block the well bore.

After pressure testing, a 140 g sample was placed in water at 150° F. for four days. After four days, the mass had decreased to 120 g. In a second test, a 160 g sample was placed in water at 200° F. for four days. After four days, the mass of the sample had decreased to 130 g. Acids may expedite dissolution. Kureha Corporation has provided the following formula for estimating single-sided degradation of molded PGA from thermal stress alone, measured in mm/h:

$$\Delta mm = -0.5 \exp(23.654 - 9443/K)$$

These time spans are consistent with the times at which conventional frac balls are drilled out, after their fracking operation blocking function has been accomplished. Therefore, the PGA frac ball can be used as a conventional frac ball and perform the fracking operation blocking function of a conventional frac ball, but can then be left in the well rather than drilling it out or other intervention by the operator. In an exemplary application, a series of frac balls is used in a fracking operation. Some prior art frac balls have sometimes stuck in their ball seat. The PGA frac ball does not stick in its ball seat. After they perform their fracking operation function, the frac balls begin to lose structural integrity, their volumes decrease slightly and they pass through their respective ball seats and move toward the toe of the well bore. The frac balls each continue to lose structural integrity until they each eventually form a soft mush without appreciable crystalline structure. This material can be left downhole without concern. Over a period of months, the PGA material biodegrades to environmentally friendly fluids and gases. In one exemplary embodiment, PGA frac balls substantially lose structural integrity in approximately 48 hours in a well with an average temperature of approximately 250° F., and completely biodegrades over several months.

It is believed degradation of the PGA in downhole conditions is primarily accomplished by random hydrolysis of ester bonds which reduces the PGA to glycolic acid, an organic substance that is not considered a pollutant and is not generally harmful to the environment or to people. Indeed, glycolic acid is used in many pharmaceutical preparations for absorption into the skin. Glycolic acid may further breakdown into glycine, or carbon dioxide and water. For example, in one test, after 91 days in fluid at 250° F., the PGA ball degraded to less than 90% of its initial weight and had biodegradability equal to cellulose subjected to similar conditions. Thus, even in the case of PGA mechanical tools that are ultimately drilled out, the remnants can be safely discarded without causing environmental harm.

Processing of the PGA material comprises in one embodiment obtaining appropriate PGA, extruding it into machinable stock, and machining it into the desired configuration. In one embodiment, Kuredux® brand PGA is purchased from the Kureha Corporation. In an exemplary embodiment, grade 100R60 PGA is purchased from Kureha Corporation through its U.S. supplier, Itochu in pellet form. The pellets are melted down and extruded into bars or cylindrical stock. In one embodiment, the extruded Kuredux® PGA resin bars are cut and machined into up to 63 different sizes of PGA balls ranging in size from 0.75 inches to 4.625 inches in 1/16-inch increments. In another embodiment, the balls are machined in 1/8 inch increments. In a preferred embodiment, the balls are milled on a lathe. The 63 different sizes correspond to matching downhole tool sliding sleeves. The smallest ball can be put down into the well first and seat onto the smallest valve. The next smallest ball can be pumped down and seat on the second smallest seat, and so forth. These ranges and processing methods are provided by way of example only. PGA frac balls smaller than 0.75 inches or larger than 4.625 inches and with different size increments can be manufactured and used. Injection molding or thermoforming techniques known in the art may also be used.

In an exemplary embodiment of the present invention as seen in FIG. 1, a well bore 150 is drilled into a hydrocarbon bearing formation 170. A frac sleeve 100 inserted into well bore 150 isolates the zone 1 designated 162 from zone 2 designated 164. Zone 1 and zone 2 are conceptual divisions, and are not explicitly delimited except by frac sleeve 100 itself. In an exemplary embodiment, hydrocarbon formation 170 may be divided into up to 63 or more zones to the extent practical for the well as is known in the art. Zone 1 162 has already been fracked, and now zone 2 164 needs to be fracked. PGA frac ball 110, which has an outer diameter selected to seat securely into ball seat 120, is pumped down into the well bore 150. In some embodiments, frac sleeve 100 forms part of the tubing or casing string.

Frac sleeve 100 includes a shifting sleeve 130, which is rigidly engaged to ball seat 120. Initially, shifting sleeve 130 covers frac ports, 140. When PGA frac ball 110 is seated into ball seat 120 and high-pressure fracking fluid fills well bore 150, shifting sleeve 130 mechanically shifts, moving in a down-hole direction. This shifting exposes frac ports 140, so that there is fluid communication between frac ports 140 and hydrocarbon formation 170. As the pressure of fracking fluid increases, hydrocarbon formation 170 fractures, freeing trapped hydrocarbons from hydrocarbon formation 170.

In an alternative preferred embodiment, a frac ball 110 is pumped down into the wellbore, seated in a ball seat at the lower end of the well, and pressure is applied at the surface of the well, or other point about the casing, to volume test the casing. This enables a volume test on the casing without intervention to remove the frac ball 110, which naturally biodegrades.

Frazier, et al., have found that PGA frac balls made of Kuredux® PGA resin will begin to sufficiently degrade in approximately 48 hours in aqueous solution at approximately 250° F. so that the PGA frac ball will cease to be held upon its seat and instead pass through the seat to unblock the well bore. The substrate PGA material has a crystalline state with about a 1.9 g/cm3 density and an amorphous state with an about 1.5 g/cm3 density. It is believed that the described PGA frac ball, when pumped down the well, begins in a hard, semi-crystalline, stable state and that its immersion in hot downhole fluid, at least as hot as 136° F., causes the PGA frac ball to begin change from its hard partly crystalline state into its more malleable amorphous state. It is believed that the frac ball in the hot downhole fluid may also be losing exterior surface mass as it hydrolyzes or dissolves. These processes both reduce the frac ball's diameter and make the serially-revealed outer material of the frac ball more malleable. It is believed the degradation of PGA and downhole conditions has two stages. In the first stage, water diffuses into the amorphous regions. In the second stage, the crystalline areas degrade. Once serious degradation begins, it can progress rapidly. In many cases, a mechanical tool made of PGA will experience sudden mechanical failure at an advantageous time after it has fulfilled its purpose, for example, within approximately 2 days. It is believed that mechanical failure is achieved by the first stage, wherein the crystalline structure is compromised by hydrolysis. The resultant compromised material is a softer, more malleable PGA particulate matter that otherwise retains its chemical and mechanical properties.

Over time, the particulate matter enters the second stage and begins biodegradation proper. The high pressure of fracking on the frac ball against the seat is believed to deform the spherical PGA frac ball in its partially amorphous state and deteriorating outer surface, by elongating it through the seat and eventually pushing it through the seat. The presence of acids may enhance solubility of the frac ball and speed degradation. Increasing well bore pressure is believed to speed release of the frac ball by increasing fluid temperature and mechanical stress on the ball at the ball/seat interface.

Advantageously, PGA frac balls made of Kuredux® PGA resin have strength similar to metals. This allows them to be used for effective isolation in the extremely high pressure environment of fracking operations. Once the Kuredux® PGA resin balls start to degrade, they begin to lose their structural integrity, and easily unseat, moving out of the way of hydrocarbon production. Eventually, the balls degrade completely.

Kuredux® PGA resin or other suitable PGA can also be used to manufacture other downhole tools that are designed to be used to perform their similar conventional tool function but, rather than them being removed from the well bore by being drilled out instead deteriorate as taught herein. For example, a flapper valve, such as is disclosed in U.S. Pat. No. 7,287,596, incorporated herein by reference, can be manufactured with Kuredux, so that it can be left to deteriorate after a zone has been fracked. A composite bridge plug can also be manufactured with PGA. This may obviate the need to mill out the bridge plug after fracking, or may make milling out the bridge plug faster and easier. As disclosed herein, such elements will initially function as conventional elements; but, after being subjected to downhole fluids of the pressures and temperatures disclosed herein will degrade and then disintegrate, eliminating the need to mechanically remove them from the well.

Kuredux® PGA resin specifically has been disclosed here as an exemplary material for use in creating degradable PGA frac balls. Furthermore, while the PGA balls in this exemplary embodiment are referred to as "PGA frac balls," those having skill in the art will recognize that such balls have numerous applications, including numerous applications in hydrocarbon recovery. Embodiments disclosed herein include any spherical ball constructed of substantially of high-molecular weight polyglycolic acid which has sufficient compression resistance and structural integrity to be used as a frac ball in hydrocarbon recovery operations and which then degrades and disintegrates, so it is not necessary to mechanically remove the ball from the well.

FIGS. 2-13 and FIGS. 24A and 24B below illustrate downhole tools for well completion, remediation, abandonment or other suitable uses. Included are downhole tools for frac applications, including hydraulic fracking. These include tools for plug and perf frac applications. The structural members' function will be apparent to one skilled in the art. In one embodiment, the tool illustrated may have at least one (and up to all) structural members that is non-composite (homogenous), non-metallic, and degradable. As used herein, an element is degradable if, when exposed to a downhole fluid having a temperature greater than about 150° F., it substantially degrades into environmentally harmless substances. Further details regarding degradable materials and structure may be found in US 2013/0240201, the contents of which are incorporated by reference.

In one embodiment, the one or more degradable structural members are comprised of polyglycolic acid, including Kuredux® 100R60 from Kureha Corp. or TLF-6267 polyglycolic acid ("PGA") from DuPont Specialty Chemicals. Additional suitable dissolvable materials include polymers and biodegradable polymers, for example, polyvinylalcohol based polymers such as the polymer Hydrocene™ available from 5 droplax, S.r.l. located in Altopascia, Italy, polylactide ("PLA") polymer 4060D from Nature-Works™, a division of Cargill Dow LC; polycaprolactams and mixtures of PLA and PGA; solid acids, such as sulfamic acid, trichloroacetic acid, and citric acid, held together with a wax or other suitable binder materials; polyethylene homopolymers and paraffin waxes; polyalkylene oxides, such as polyethylene oxides, and polyalkylene glycols, such as polyethylene glycols. These polymers may be preferred in water-based drilling fluids because they are slowly soluble in water.

In one of the foregoing embodiments, some of the non-degradable structural elements are comprised of easily milled composites, such as resin/fiber mixes known in the art. In another of the following embodiments, where slips, elastomers, and springs are disclosed, one or more of these may be non-degradable, and made from known, prior art material.

Figure 2:
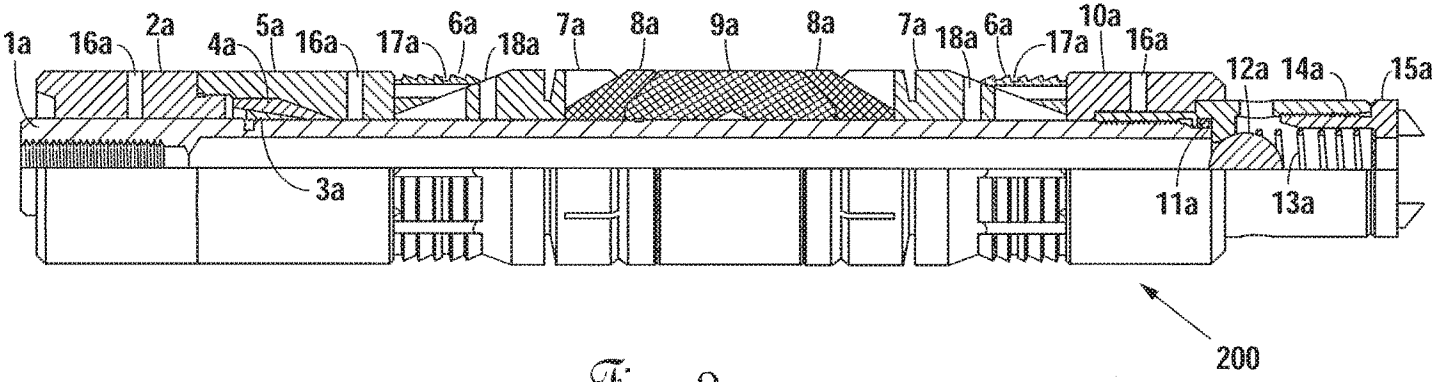
FIG. 2 is a cutaway side view of a mechanical set composite cement retainer with poppet valve, having PGA structural members.

FIG. 2 is a cutaway side view of an exemplary embodiment of a wire line cement retainer with a poppet valve assembly. This tool has functions apparent to one skilled in the art, such as remedial cementing or zone abandonment. The poppet one-way check valve may be opened in conjunction with a stinger assembly and applied pressure from the surface.

This tool may have one or a plurality of structural members made from a degradable material, in one case PGA, which members may include one or more of the following, whose functions and structure are apparent to those of ordinary skill in the art: 1*a* mandrel: 2*a* ball drop push sleeve cap; 3*a* mandrel lock (ratchet) ring; 4*a* mandrel lock ring insert; 5*a* push sleeve; 6*a* slip; 7*a* backup cone; 8*a* end element (elastomer); 9*a* center element (elastomer); 10*a* shoe nut bottom; 11*a* O-ring; 12*a* ball bearing; 13*a* compression spring; 14*a* bottom nut; 15*a* bottom sub; 16*a* socket head; 17*a* slip retainer; and 18*a* socket head.

In one embodiment, one or more of the structural members are made of PGA (polyglycolic acid). In another embodiment, the slips are metallic or other composition known in the art, center elements 8*a* and 9*a* are known non-degradable elastomers, and compression spring 13*a* made of steel or of known prior art composition. In another embodiment, some of the elements of the plug are degradable, including PGA and some of a low metallic composite material, such as a fiber and resin.

Cement retainer 200 can be set on a wire line or coil tubing used in conventional setting tools. Upon setting, the stinger assembly is attached to the work string and run to retainer depth. The stinger is then inserted into the retainer bore, sealing against the mandrel inner diameter, and isolating the work string from the upper annulus.

Cement retainer 200 may also, in one embodiment, include PGA slips, which may be structurally similar to prior art iron slips, which are molded or machined PGA according to methods disclosed herein. Teeth may be added to the tips of the PGA slips to aid in gripping raw casing and be made of iron, tungsten carbide or other hard materials known in the art. In other embodiments (see FIGS. 23A-23C), the PGA slip may include a PGA based material with hardened buttons of ceramic, iron, tungsten carbide or other hard materials embedded therein. Some embodiments of cement retainer 200 may be configured for use with a PGA or other degradable frac ball 110.

Once sufficient set down weight has been established, applied pressure (cement) is pumped down the working string, opening the one-way check valve, and allowing communication beneath the cement retainer 200. In some embodiments, with PGA elements or other degradable elements as part thereof, cement retainer 200 may require no drilling whatsoever, the degradable elements simply breaking down at the downhole heat and pressure. In some embodiments, the metallic elements remaining after the degradable elements degrade may be sufficiently small to pump out of the wellbore or drop to the bottom of the well. In other embodiments, minimal drilling may be required to clean out the remaining metallic pieces.

Figure 3:
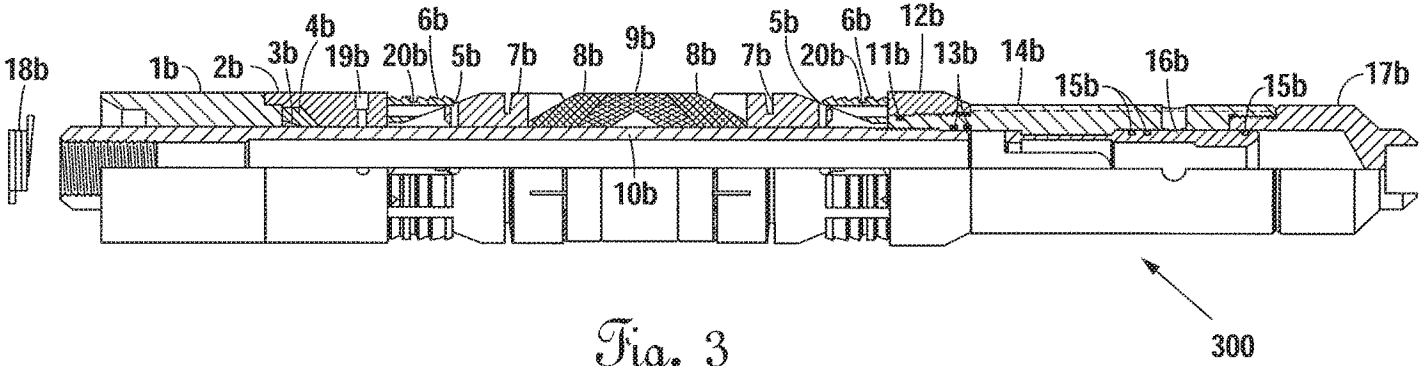
FIG. 3 is a cutaway side view of a wireline set composite cement retainer with sliding check valve, having PGA structural members.

FIG. 3 illustrates a wire line cement retainer 300 with a collet 16(*b*) for use in ways known in the art. Cement retainer 300 may have one or more degradable structural members or PGA structural members, including one or more of the following: funnel 1*b*, push sleeve 2*b*, mandrel lock (ratchet) ring 3*b*, mandrel lock ring insert 4*b*, socket head 5*b*, slip section 6*b*, backup cone 7*b*, end element 8*b*, center element 9*b*, mandrel 10*b*, O-ring 11*b*, bottom nut 12*b*, O-ring 13*b*, collet housing 14*b*, O-ring 15*b*, collet 16*b*, bottom sub 17*b*, tension spring 18*b*, socket head 19*b*, and slip retainer 20*b*. in another embodiment, some of the elements, such as slips, elastomers, and springs, may be made of known prior art materials, including non-degradable elastomers and metals. In another embodiment, some of the elements of the plug are degradable, including PGA and some of a low metallic composite material, such as a fiber and resin.

Figure 4:
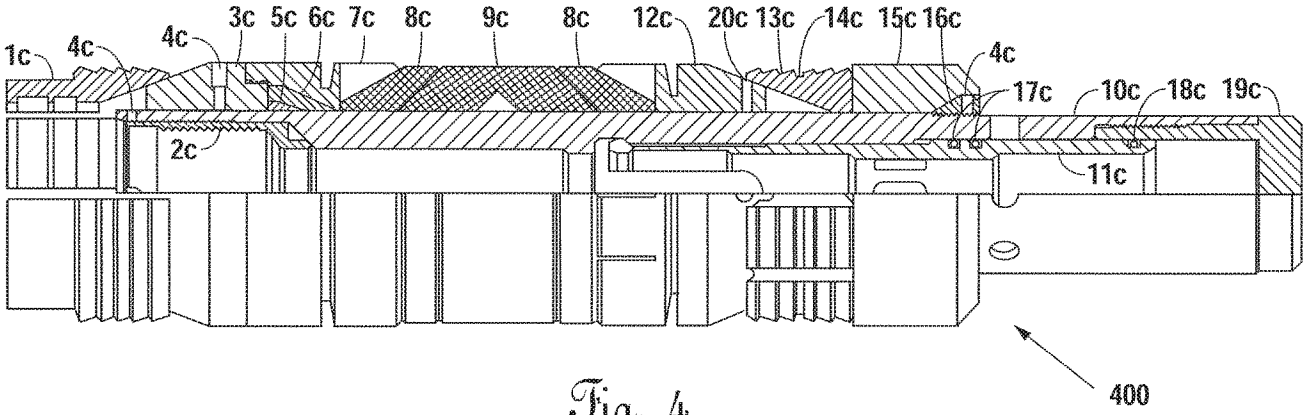
FIG. 4 is a cutaway side view of a mechanical set composite cement retainer with sliding sleeve check valve, having PGA structural members.

FIG. 4 illustrates a cutaway side view of an exemplary embodiment of a mechanically set retainer 400 with one or more of the following elements comprising a degradable material, in one case, PGA: top slip section 1*c*, stinger latch ring 2*c*, top cone 3*c*, socket head 4*c*, mandrel lock (ratchet) ring 5*c*, mandrel lock ring insert 6*c*, top backup cone 7*c*, end element 8*c*, center element 9*c*, mandrel 10*c*, collet 11*c*, backup cone 12*c*, slip section 13*c*, slip retainer 14*c*, lower cap 15*c*, lower lock ring 16*c*, O-ring 17, O-ring 18*c*, bottom sub 19*c*, socket head 20*c*. in another preferred embodiment, one or more elements may be a composite material as known in the art. In another embodiment, the slips and elastomers may be made of materials known in the art.

Figure 5:
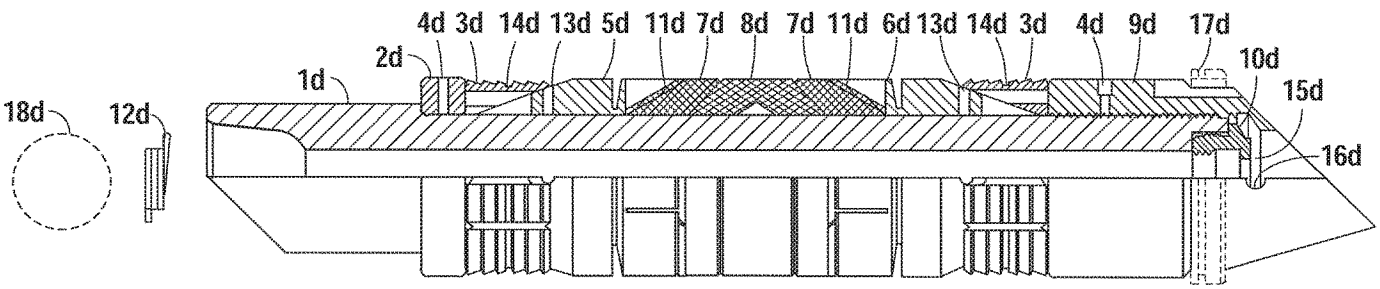
FIG. 5 is a cutaway side view of a PGA frac plug.

FIG. 5 is a cutaway side view of an exemplary embodiment of a frac plug 500 that may be comprised of one or more degradable elements including, in one embodiment, PGA or may be a combination of PGA composite and traditional, prior art materials. The PGA (degradable) element may include one or more of the following: mandrel 1*d*, load ring 2*d*, slip section 3*d*, socket head 4*d*, backup cone 5*d*, backup cone 6*d*, end element 7*d*, center element 8*d*, bottom (standard conical) 9*d*, sheer sub 10*d*, backup spring 11*d*, torsion spring 12*d*, socket heads 13*d*, and slip retainer 14*d*. Some of the foregoing elements may be made of traditional materials, such as the springs, elastomers, slips. For a ball drop configuration, ball 18*d* may be degradable or non-degradable. For wiper style pumpdown configuration only, bolt 15*d*, washer lock 16*d*, and pumpdown elements 17*d* may be made of degradable material or conventional materials.

Figure 6:
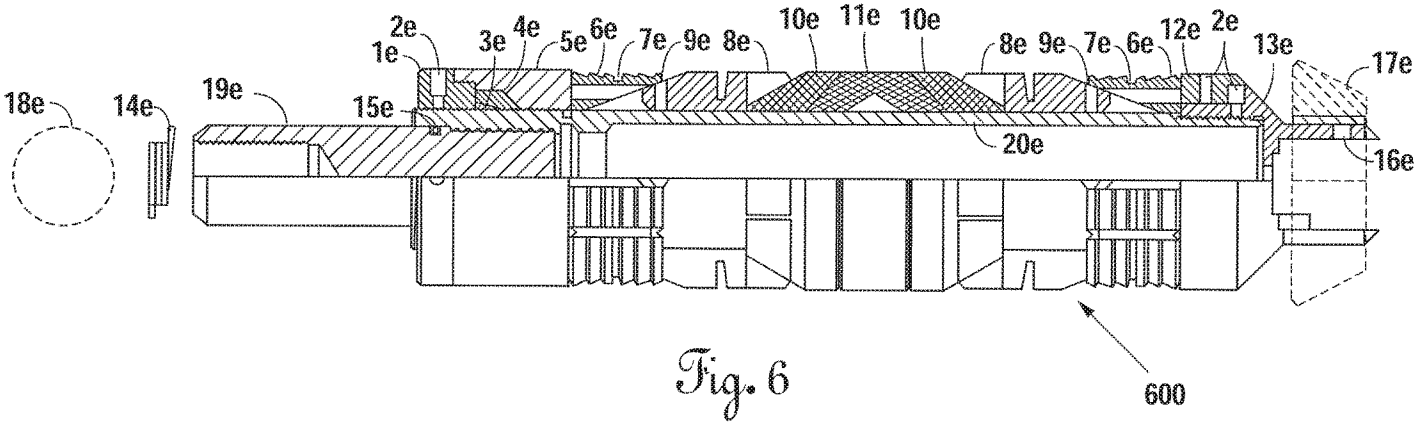
FIG. 6 is a cutaway side view of a temporary isolation tool with PGA structural members.

FIG. 6 is a cutaway side view of an exemplary embodiment of a temporary isolation tool 600 including, in one embodiment, a ball drop plug that may have one or more of the following elements comprised of a degradable material: push sleeve 1*e*, socket head 2*e*, mandrel lock (ratchet) ring for push sleeve 3*e*, mandrel lock ring insert for push sleeve 4*e*, push sleeve 5*e*, slip sections 6*e*, slip retainers 7*e*, backup cones 8*e*, socket heads 9*e*, end elements 10*e*, center element 11*e*, bottom shoe nut 12*e*, bottom nut 13*e*, torsion spring 14*e*, O-ring 15*e*. Pumpdown element may include aluminum bolts 16*e* and pumpdown element 17*e*. Ball drop may include ball 18*e*, shear sub ball drop plug 19*e*, and mandrel 20*e*. In one embodiment, some of the foregoing elements are PGA, some are composite, and some conventional materials.

In one embodiment, temporary isolation tool 600 is in a "ball drop" configuration and the PGA (or a non-degradable) frac ball 18*e* may be used therewith. As known in the art, temporary isolation tool 600 may be combined with three additional on-the-fly inserts (a bridge plug, a flow back valve or a flow back valve with a frac ball, providing additional versatility). In some embodiments, a pumpdown wiper 17*e*, in one case a degradable material, may be employed to aid in inserting temporary isolation tool 600 in the horizontal wellbores.

Figure 7:
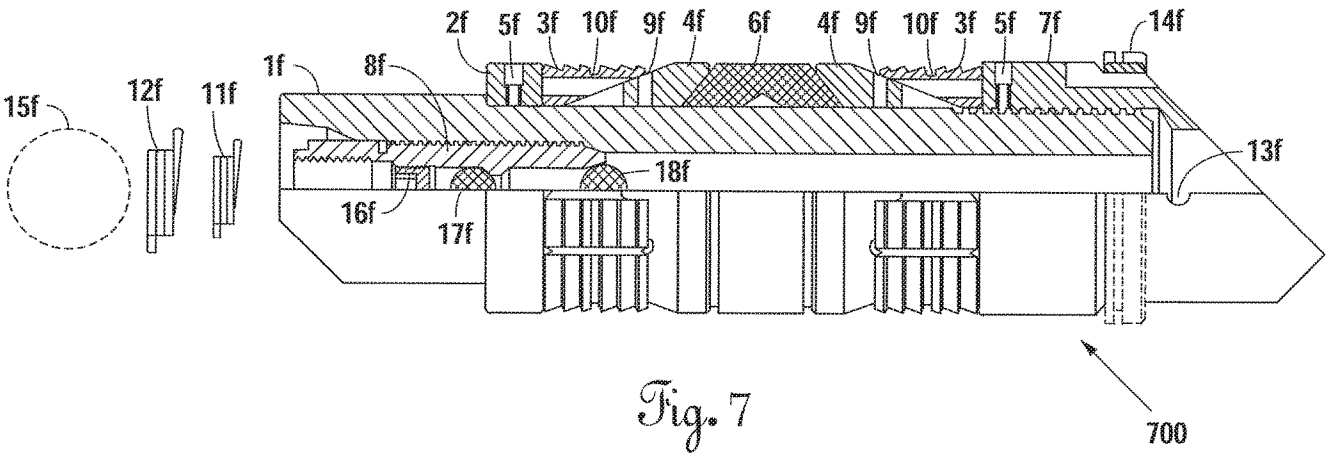
FIG. 7 is a cutaway side view of a snub nose composite plug having PGA structural members.

FIG. 7 is a cutaway side view of an exemplary embodiment with a snub nose plug 700. The degradable elements of the snub nose plug 700 may include one or more of the following degradable elements: mandrel 1*f*, load ring 2*f*, slip sections 3*f*, cones 4*f* set screws 5*f*, center element 6*f*, bottom (standard wedge) 7*f*, shear sub insert 8*f*, set screws 9*f*, slip retainers 10*f*, tension spring 11*f*, tension spring 12*f*. A degradable PGA wiper 14*f* may be used to aid inserting snub nose plug 700 into horizontal wall bores. Snub nose plug 700 may be provided in several configurations, including a ball drop having ball 15*f* or a bridge plug with insert 16*f*. Configured as a snub nose flowback standard wedge bottom, flowback insert 16*f* may be used with ballbearing 17*f* and ball 18*f* for mid-range or high range use.

Figure 8:
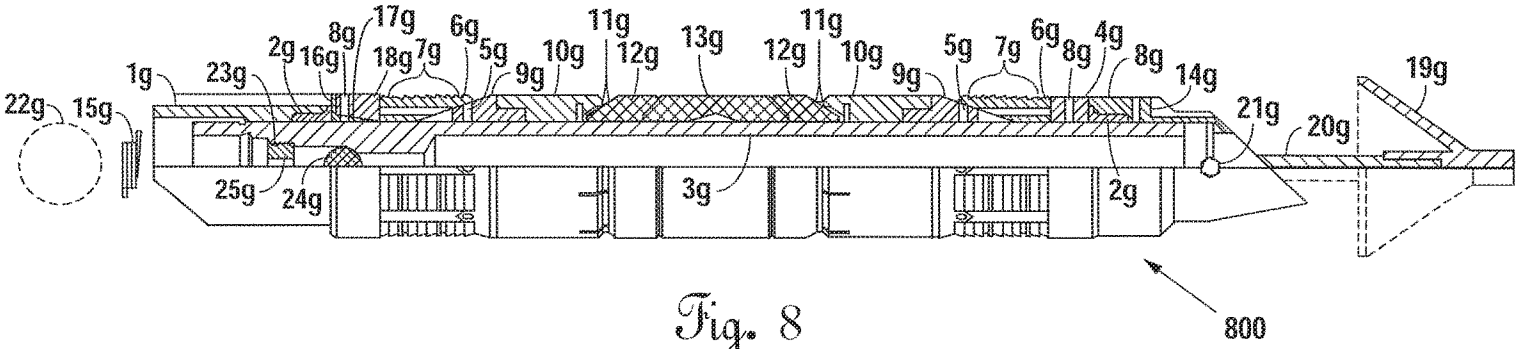
FIG. 8 is a cutaway side view of a long-range PGA frac plug.

FIG. 8, in one embodiment, a long range plug 800 is provided having a number of common components as well as add-ons. Among the common components of long range plug 800 are the following, at least one of which may be made of a degradable (in one case PGA) material: plug collar 1*g*, thrust rings 2*g*, mandrel 3*g*, load ring 4*g*, socket heads 5*g*, slips 6*g*, slip retainers 7*g*, socket heads 8*g*, cones 9*g*, backup cones 10*g*, backup cones (metallic) 11*g*, end elements 12*g*, center element 13*g*, shoe bottom 14*g*, torsion spring 15*g*, body lock ring retainer 16*g*, mandrel lock ratchet ring 17*g*, ratchet load ring retainer 18*g*. The add-ons may include a dart wiper 19*g* or other suitable wiper, a pumpdown mandrel 20*g*, and an aluminum bolt 21*g*.

A ball drop having ball bearing 22*g* may be added in one embodiment. A bridge plug insert 23*g* may be provided as well as the flowback add-ons, ball bearing 24*g*, and flowback insert 25*g*.

Any one or more of the foregoing elements may be PGA or other degradable material. In one embodiment, long range composite frac plug 800 is operated according to methods known in the art, enabling wellbore isolation in a broad range of environments and applications. Because long range frac plug 800 has a slim outer diameter, for example, about 3.9", it may be used with restricted internal casing diameters or existing casing patches in a wellbore.

When built with a oneway check valve, long range frac plug 800 temporarily prevents sand from invading the upper zone and eliminates cross-flow problems, in some embodiments, by using a degradable frac ball, such as disclosed herein. After the frac ball has degraded, fluids in the two zones may co-mingle. The operator can then independently treat or test each zone and remove the flow plugs in an underbalance environment in one trip. In one embodiment, long range frac plug 800 is left in the wellbore and the degradable elements, including PGA elements, are permitted to breakdown naturally. In some embodiment, the remaining metallic pieces may be sufficiently small to pump it out of the wellbore or drop to the bottom of the well. In other embodiments, more drilling may be required to clean up remaining metallic bits.

Figure 9:
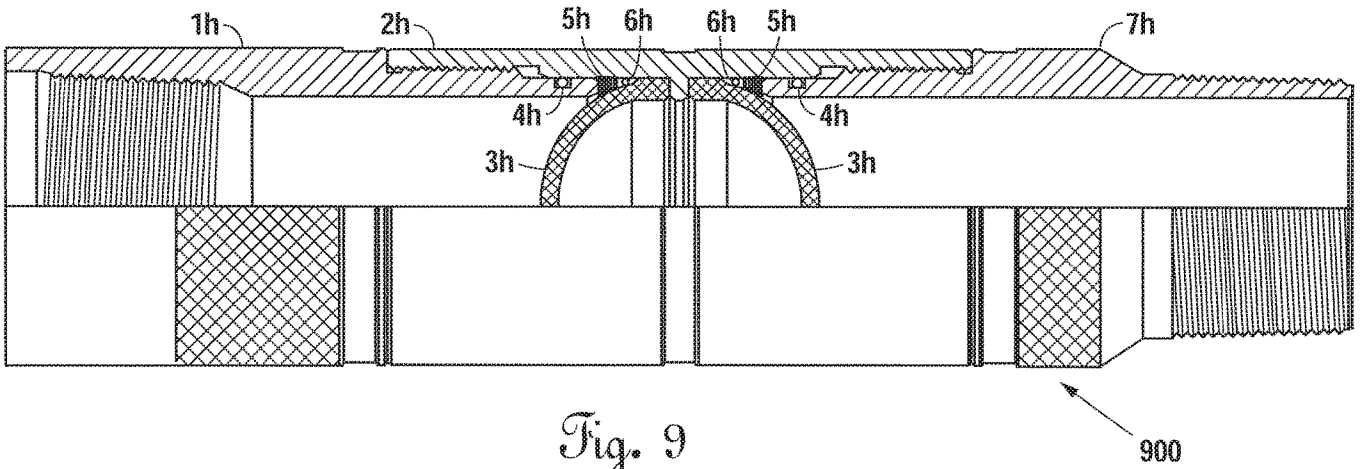
FIG. 9 is a cutaway side view of a dual disk frangible knockout isolation sub, having PGA disks.

FIG. 9 is a cutaway side view of an exemplary embodiment of a dual disk frangible knockout isolation sub 900. In an exemplary embodiment, dual disk isolation sub 900 may include a box body 1*h*, dual housing 2*h*, degradable disks including PGA disks 3*h* fixedly engaging a support structure comprising the box body and the dual housing at a perimeter of the disk, O-rings such as 90 durometer O-rings 4*h*/5*h*, anti-extrusion O-rings such as PTFE O-rings 6*h*, and pin body 7*h*. In one embodiment, only the disks are degradable.

In one embodiment, the two dome-shaped disks are a degradable material, such as PGA. In one embodiment, dual disk isolation sub 900 is under the bottom of the tubing and/or below a production packer BHA (Bottom Hole Assembly). After the production packer is set with the dual disks, the wellbore reservoir is isolated. After the upper production BHA is run in hole, latched into the packer, and all tests performed, the disks can be knocked out using a drop bar, coil tubing, slip line or sand line or they may be allowed to degrade. Once the disks are gone, the wellbore fluids can then be produced up the production tubing. The disks may be dome-shaped as illustrated or curved or flat. If the disks are broken, the individual degradable pieces may then degrade.

Figure 10:
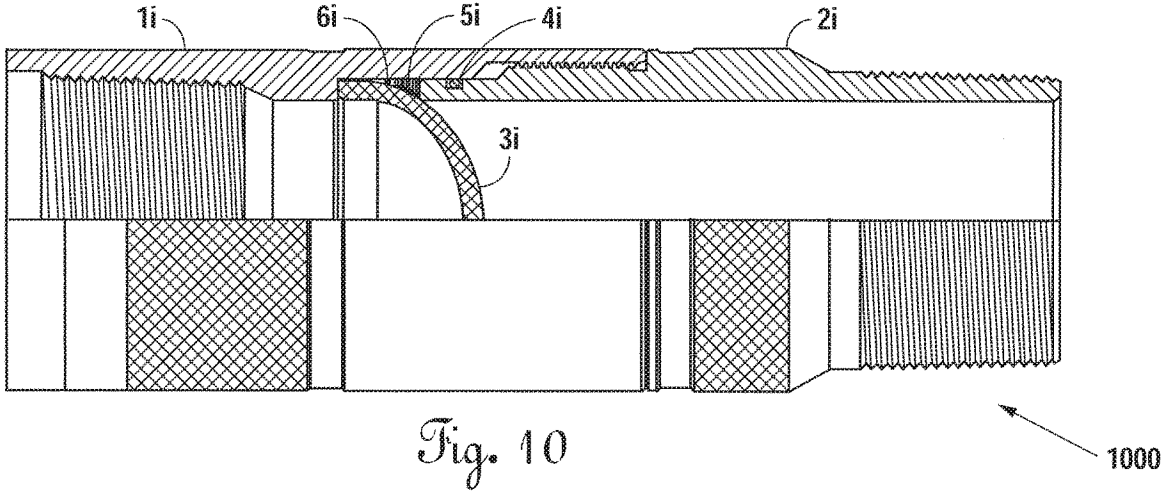
FIG. 10 is a cutaway side view of a single disk frangible knockout isolation sub.

FIG. 10 is a cutaway side view of an exemplary embodiment of a single disk, frangible knockout isolation sub 1000. In one embodiment, single disk isolation sub 1000 includes single body housing 1*i*, pin body 2*i*, a degradable disk 3*i* fixedly engaging a support structure comprising the body housing and pin body at a perimeter of the disk, O-rings 4*i*/5*i*, such as 90 durometer O-rings, and O-ring 6*i* such as a PTFE anti-extrusion O-ring. The single PGA disk may be dome-shaped, may be a solid cylindrical plug or any other suitable shape, including curved or flat.

For both snubbing and pumpout applications, isolation sub 1000 provides an economical alternative to traditional methods. It is designed to work in a range of isolation operations. Isolation sub 1000 may be run to the bottom of the tubing or below production packer bottom hole assembly (BHA). Once the production packer is set, isolation sub isolates the wellbore reservoir.

After the upper production bottom hole assembly is run in the hole, latched into the packer, and all tests are performed, degradable disk 3*i* may be pumped out. In other embodiments, a PGA disk can simply be allowed to disintegrate. Once the disk is removed or disintegrates, then wellbore fluids can be produced up the production tubing.

Figure 11:
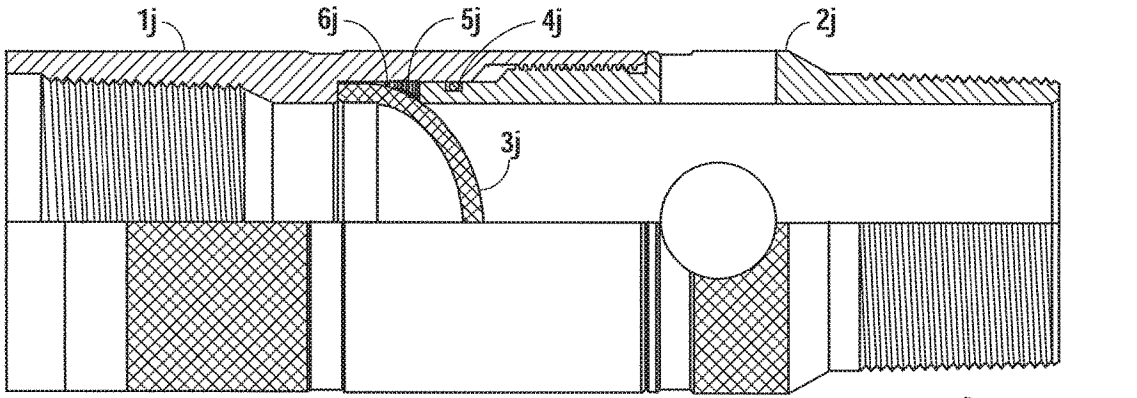
FIG. 11 is a cutaway side view of an underbalanced disk sub having a PGA disk.

FIG. 11 is a cutaway side view of an exemplary embodiment of an underbalance disk sub assembly 1100, which may in one embodiment include a single housing 1*j*, and an underbalance pin body 2*j*. A degradable disk, including in one embodiment, a PGA disk 3*j* may be provided for fixedly engaging a support structure comprising the single housing and the pin body at a perimeter of the disk. O-rings 4*j*/5*j* may be provided, such as 90 durometer O-rings, as well as anti-extrusion PTFE O-rings 6*j*. in one embodiment, only the disk is degradable or PGA. Underbalance disk sub 1100 may be part of a casing string and production ports may be provided as seen in pin body 2*j*, which provides a hydrocarbon circulation. A single disk 3*j* may be provided for zonal isolation. Isolation sub 1100 is operated according to methods known in the art.

Figure 12:
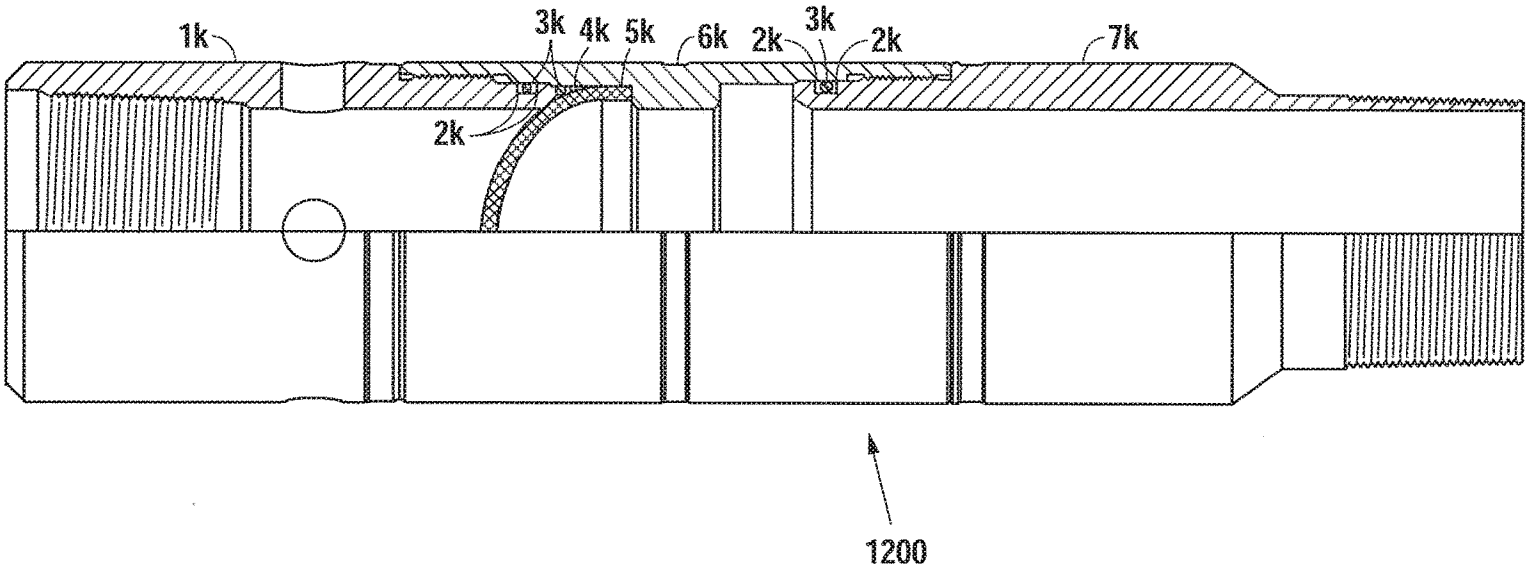
FIG. 12 is a cutaway side view of an isolation sub having a PGA disk.

FIG. 12 is a cutaway side view of an exemplary embodiment of an isolation sub assembly 1200, which may include the following elements: coated box body 1*k*, backup rings 2*k*, O-rings 3*k*/4*k*, such as 90 durometer O-rings, PGA disk 5*k*, housing 6*k*, and pin body 7*k*. Degradable disk 5*k* fixedly engages a support structure comprising the box body and housing at a perimeter of the disk.

Isolation sub assembly 1200 may have a single PGA or other degradable disk 5*k* that may be either broken in ways known in the art or allowed to dissolve at the downhole temperature and pressures in ways set forth herein at predetermined times to permit fluid communication through the isolation sub.

Figure 13:
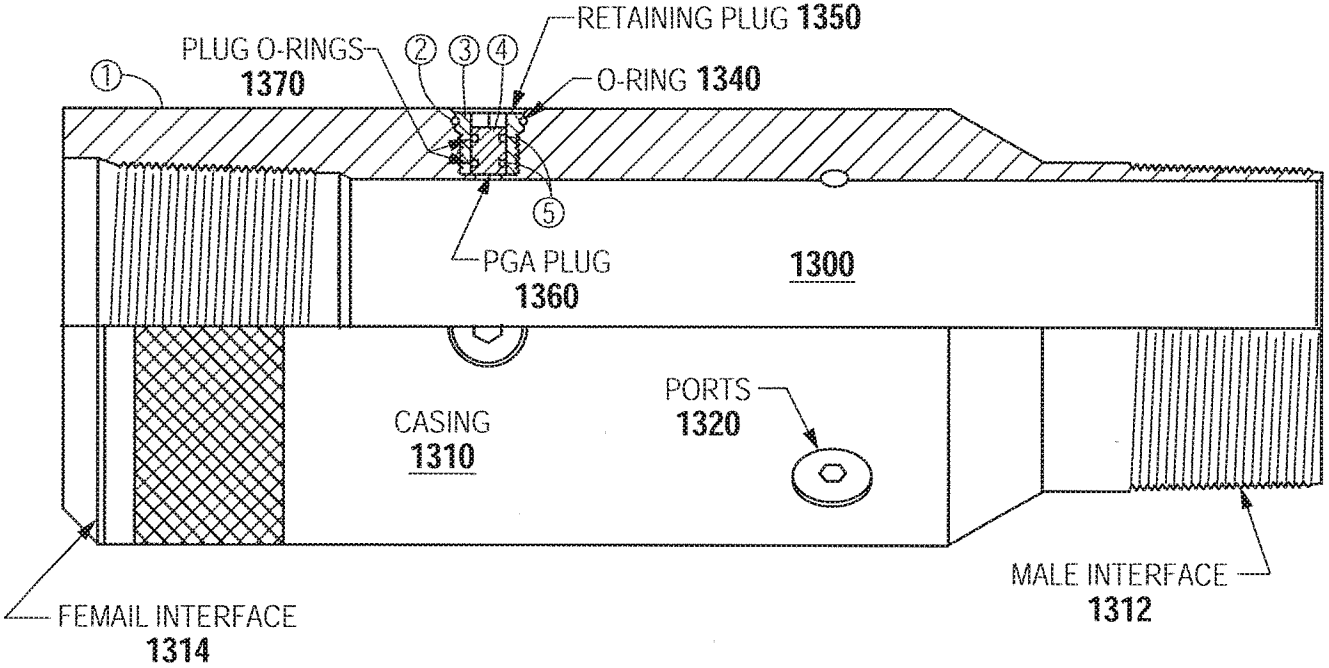
FIGS. 13-13C are detailed views of an exemplary embodiment of a balldrop isolation sub with PGA plugs.
Figure 13A:
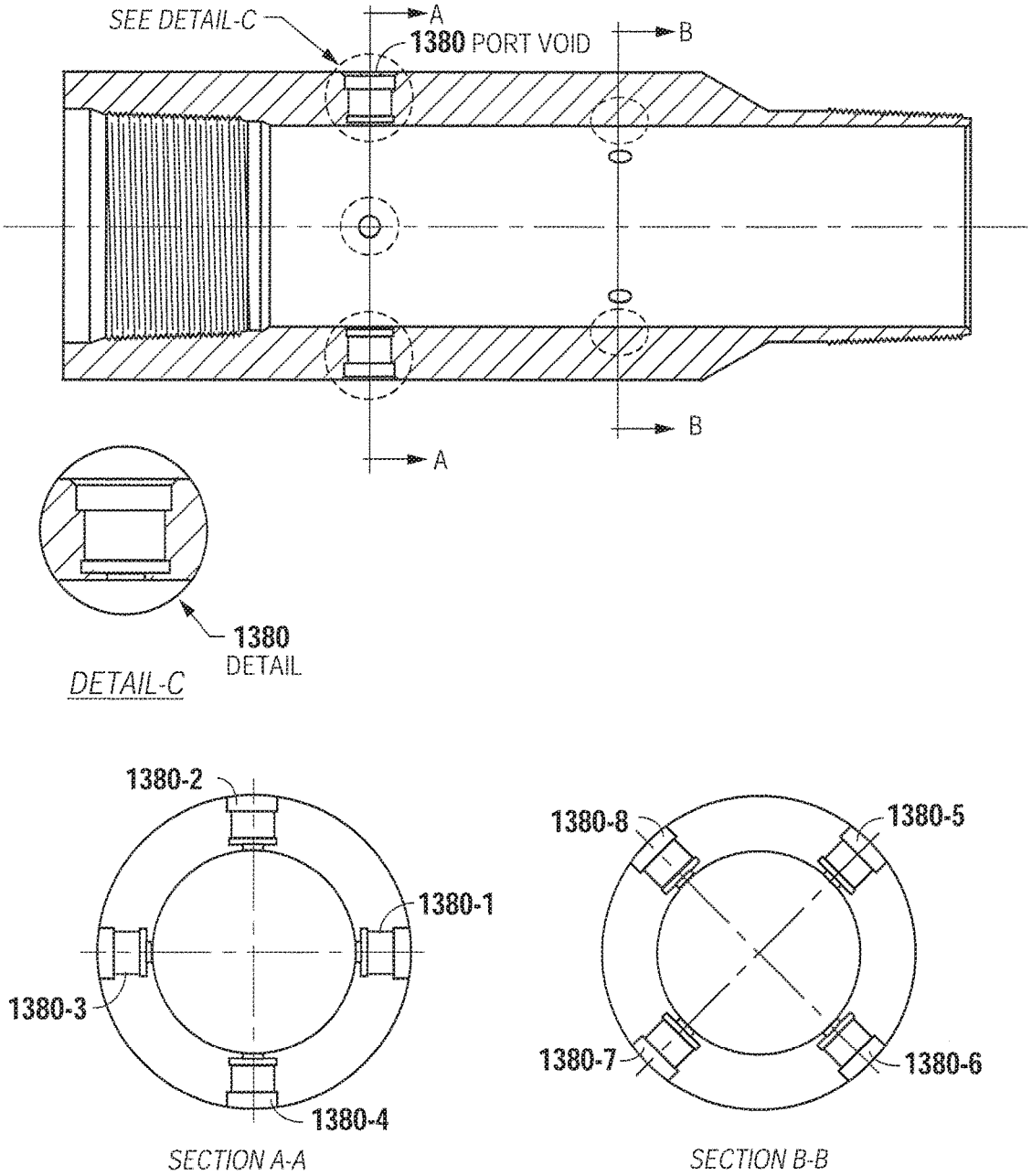
Figure 13B:
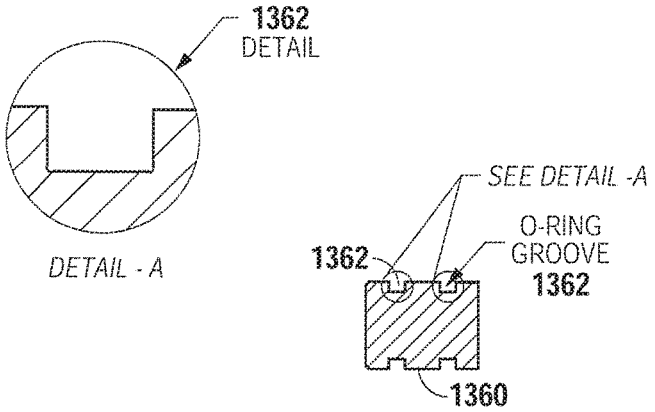
Figure 13C:
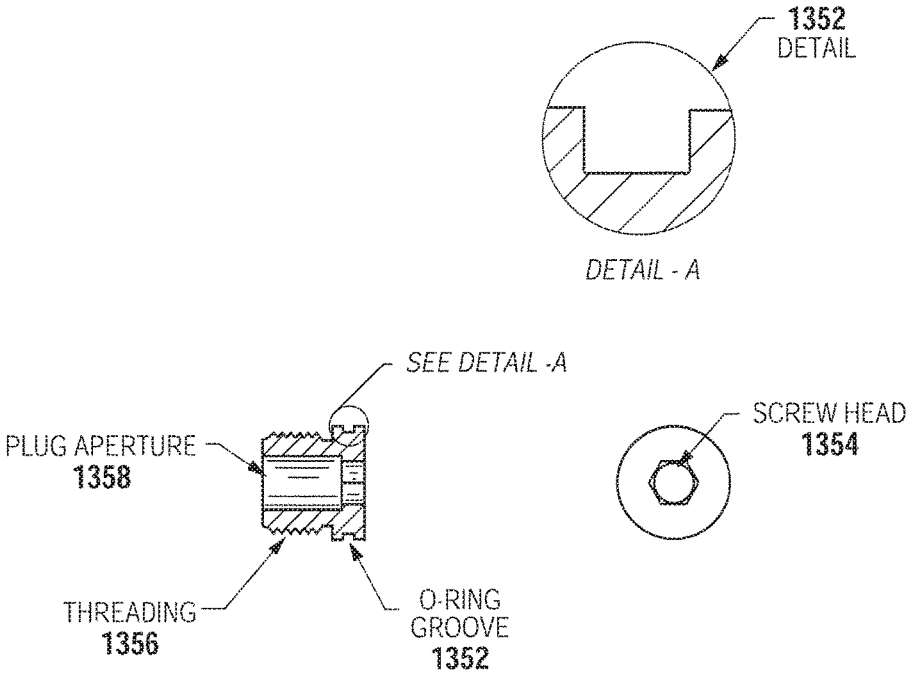

FIGS. 13-13C are detailed views of an exemplary isolation sub 1320. In FIG. 13, an exemplary embodiment, isolation sub 1300 is operated according to methods known in the prior art. FIG. 13 provides a partial cutaway view of isolation sub 1300 including a metal casing 1310. Casing 1310 is configured to interface with the tubing or casing string, including via female interface 1314 and male interface 1312, which permit isolation sub 1300 to threadingly engage other portions of the tubing or casing string. Disposed along the circumference of casing 1310 is a plurality of ports 1320. In operation, ports 1320 are initially plugged with a retaining plug 1350 during the fracking operation, but ports 1320 are configured to open so that hydrocarbons can circulate through ports 1350 once production begins. Retaining plug 1350 is sealed with a O-ring 1340 and threadingly engages a port void 1380 (FIG. 13A). Sealed within retaining plug 1350 is a degradable PGA plug 1360, sealed in part by plug O-rings 1370.

FIG. 13A is a cutaway side view of isolation sub. Shown particularly in this figure are bisecting lines A-A and B-B. Disposed around the circumference of casing 1310 are pluralities of port voids 1380, which fluidly communicate with the interior of casing 1310. Port voids 1380 are configured to threadingly receive retaining plugs 1350. A detail of port void 1380 is also included in this figure. As seen in sections A-A and B-B, two courses of port voids 1380 are included. The first course, including port voids 1380-1, 1380-2, 1380-3, and 1380-4 are disposed at substantially equal distances around the circumference of casing 1310. The second course, including port voids 1380-5, 1380-6, 1380-7, and 1380-8 are also disposed at substantially equal distances around the circumference of casing 1310 and are offset from the first course by approximately forty-five degrees.

FIG. 13B contains a more detailed side view of PGA plug 1360. In an exemplary embodiment, PGA plug 1360 is made of machined, solid-state high-molecular weight polyglycolic acid. The total circumference of degradable plug 1360 may be approximately 0.490 inches or in the range of conventional plugs. Two O-ring grooves 1362 may be included, with an exemplary width between about 0.093 and 0.098 inches each, and an exemplary depth of approximately 0.1 inches.

FIG. 13C contains a more detailed side view of a retaining plug 1350. Retaining plug 1350 includes a screw or hex head 1354 to aid in mechanical insertion of retaining plug 1350 into port void 1380 (FIG. 13A). Retaining plug 1350 also includes threading 1356, which permits retaining plug 1350 to threadingly engage port void 1380. An O-ring groove 1352 may be included to enable plug aperture 1358 to securely seal into port void 1380. A plug aperture 1358 is also included to securely and snugly receive a PGA or other degradable plug 1360. In operation, isolation sub 1300 is installed in a well casing or tubing. After the fracking operation is complete, degradable plugs 1360 will break down in the pressure and temperature environment of the well, opening ports 1320. This will enable hydrocarbons to circulate through ports 1320.

Figure 14:
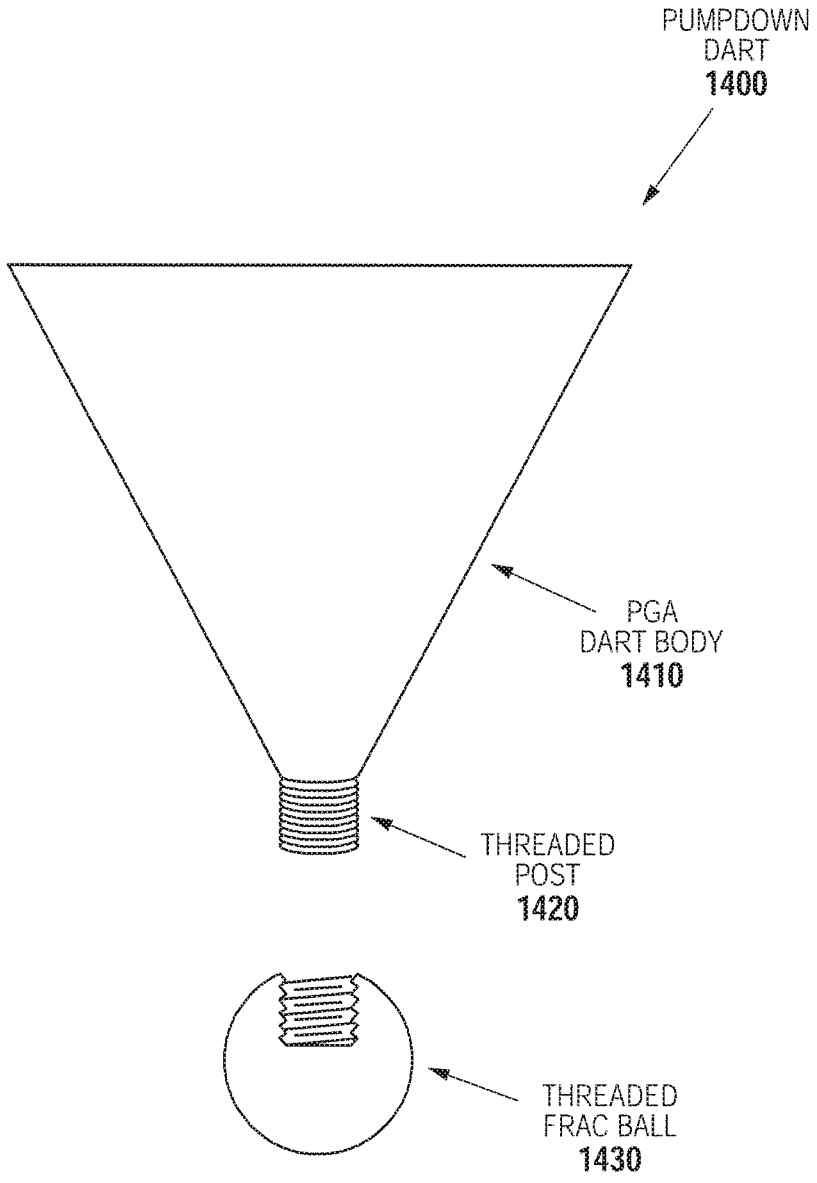
FIG. 14 is a cutaway side view of a PGA pumpdown dart.

FIG. 14 is a side view of an exemplary embodiment of a pumpdown dart 1400. In an exemplary embodiment, pumpdown dart 1400 is operated according to methods known in the prior art. In particular, pumpdown dart 1400 may be used in horizontal drilling applications to properly insert tools that may otherwise not properly proceed through the casing. Pumpdown dart 1400 includes a PGA (or other degradable) dart body 1410, which is a semi-rigid body configured to fit tightly within the casing. In some embodiments, a threaded post 1420 is also provided, which optionally may also be made of PGA material. Some applications for threaded post 1420 are known in the art. In some embodiments, threaded post 1420 may also be configured to interface with a threaded frac ball 1430. Pumpdown dart 1400 may be used particularly in horizontal drilling operations to ensure that threaded frac ball 1430 does not snag or otherwise become obstructed, so that it can ultimately properly set in a valve seat.

Advantageously, pumpdown dart 1400 permits threaded frac ball 1430 to be seated with substantially less pressure and fluid than is required to seat PGA frac ball 110.

The following relates to tests performed on degradable balls. The specific gravity of the balls tested was about 1.50. They were machined to tolerances held at about .+−.0.005 inches. Kuredux® PGA balls were field tested at a pump rate of 20 barrels per minute and exhibited high compressive strength, but relatively fast break down into environmentally friendly products.

Figure 15:
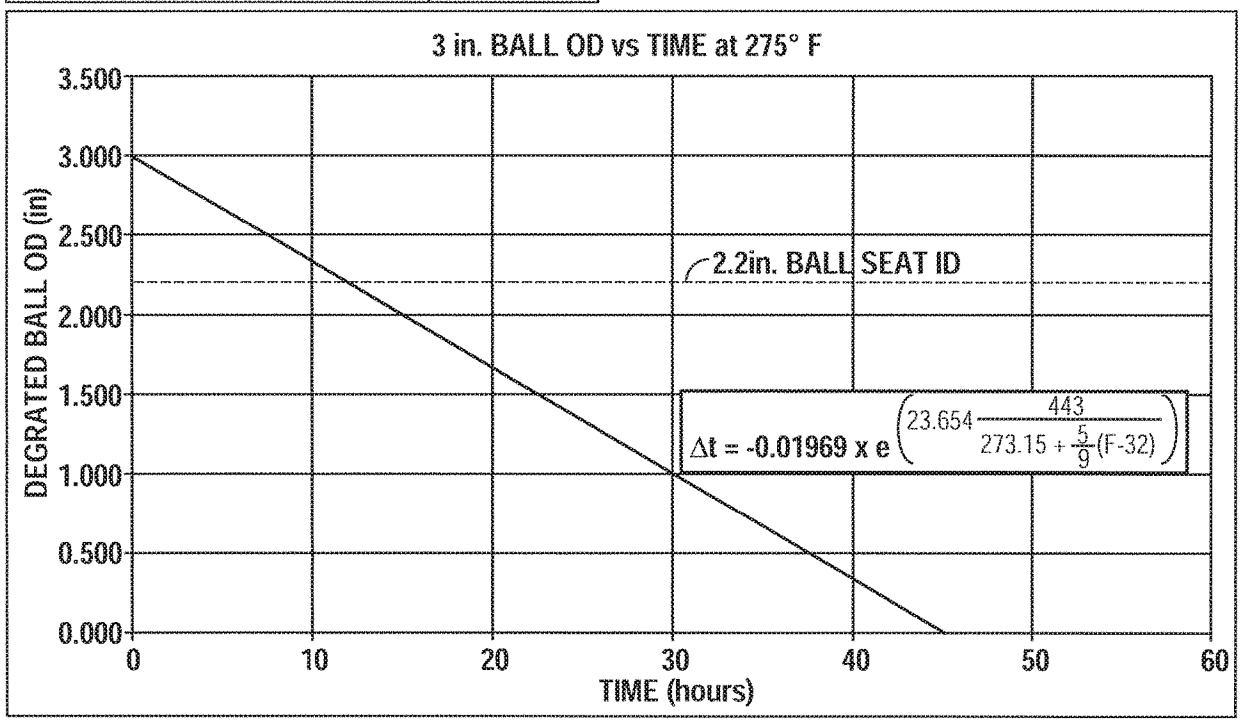
FIG. 15 illustrates a time/temperature test graph results for a 3 inch OD PGA ball at 275° F.

FIG. 15 illustrates the ball degradation rate of a 3 inch OD PGA frac ball versus time at 275.degree. F., the PGA ball made from 100 R60 Kuredux® PGA resin according to the teachings set forth herein. The 3 inch ball is set on a 2.2 inch ball seat ID and passes the ball seat at about 12 or 13 hours. Degradation rate about 0.033 inches/hour.

Figure 16:
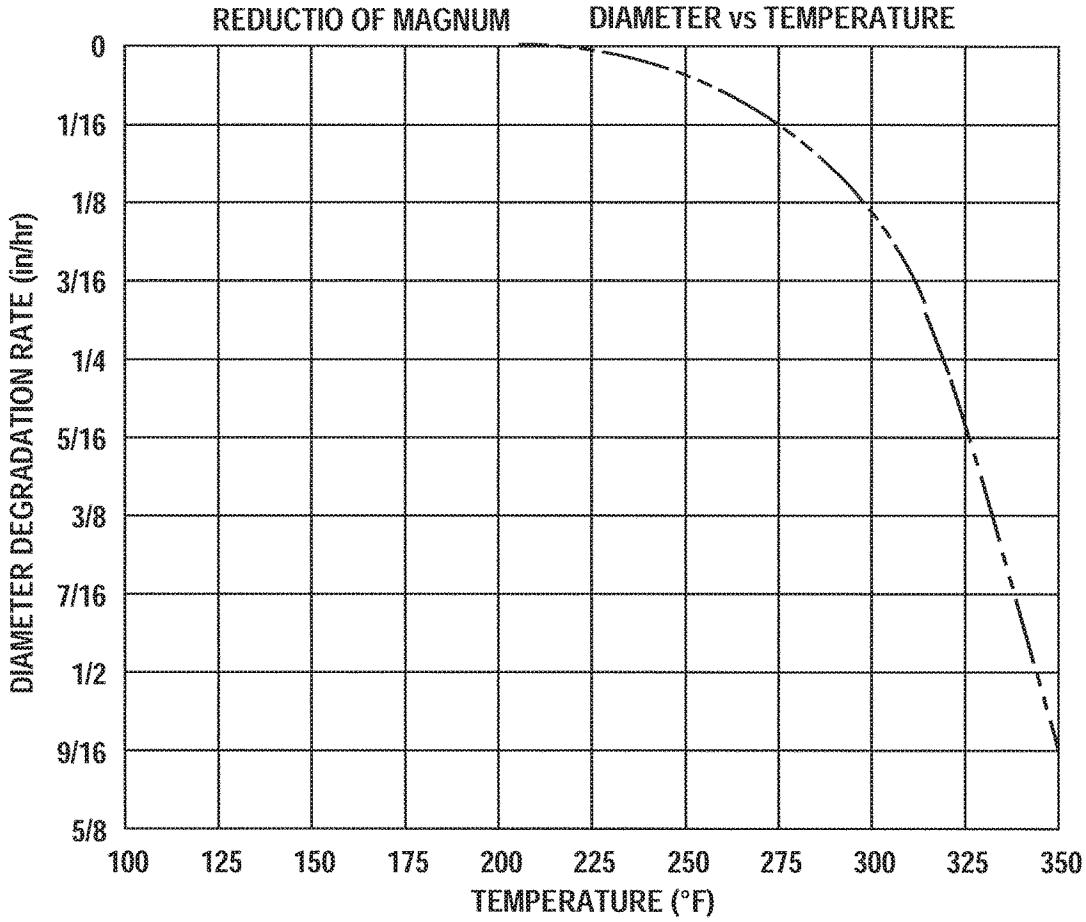
FIG. 16 illustrates reduction of the Magnum PGA ball in diameter in inches per hour at temperatures from 100° F. to 350° F.

FIG. 16 illustrates the reduction in ball diameter versus temperature. Reduction in ball diameter increases as temperature increases. A noticeable reduction in diameter is first apparent at about 125° F. More significant reduction in diameter begins at 175-200° F.

Figure 17:
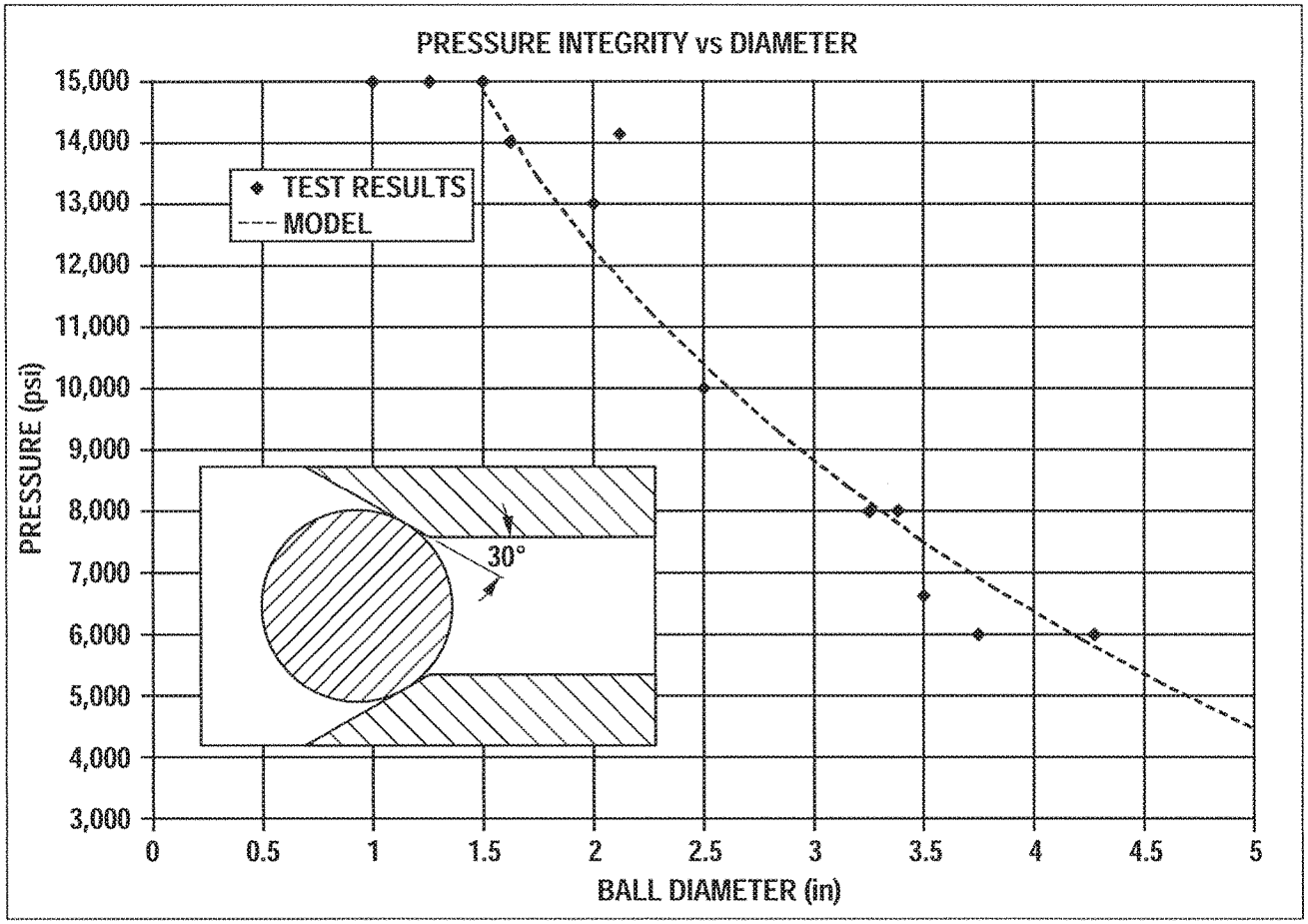
FIG. 17 illustrates integrity versus diameter for Applicant's PGA balls, subject to pressures between 3000 to 15,000 pounds, ball diameters 1.5 to 5 inches with a ⅛ inch overlap on the seat.

FIG. 17 shows a pressure integrity versus diameter curve illustrating pressure integrity of PGA frac balls for various ball diameters. It illustrates the structural integrity, that is, the strength of Kuredux® PGA resin balls beginning with a ball diameter of about 1.5 inches and increasing to about 5 inches as tested on seats which are each ⅛-inch smaller than each tested ball. The pressure testing protocol is illustrated in the examples below. The tests were performed in water at ambient temperature.

Frac Ball Example 1

A first test was performed with a 3.375 inch frac ball. Pressurizing was begun. Pressure was increased until, upon reaching 6633 psi, the pressure dropped to around 1000 psi. Continued to increase pressure. The ball passed through the seat at 1401 psi. The 3.375 inch frac ball broke into several pieces after passing through the seat and slamming into the other side of the test apparatus.

Frac Ball Example 2

A second test was performed with a 2.125 inch frac ball. Pressurizing was begun. Upon reaching 10,000 psi, that pressure was held for 15 minutes. After the 15 minute hold, pressure was increased to take the frac ball to failure. At 14,189 psi, the pressure dropped to 13,304 psi. Pressure increase continued until the ball passed through the seat at 14,182 psi.

Frac Ball Example 3

A third test was performed with a 1.500 inch frac ball. Pressurizing was begun. Upon reaching 10,000 psi, that pressure was held for 15 minutes. After the 15 minute hold, pressure was increased to 14,500 psi and held for 5 minutes. All pressure was then bled off. The test did not take this ball to failure. Removing the ball from the seat took very little effort, it was removed by hand. Close examination of the frac ball revealed barely perceptible indentation where it had been seated on the ball seat.

In one preferred embodiment, Applicant's PGA ball operates downhole from formation pressure and temperature to fracking pressures up to 15,000 psi and temperatures up to 400° F.

Frac Ball Pressure Testing Weight Loss

After pressure testing, two different pieces of the 3⅜ inch frac ball were put into water and heated to try to degrade the pieces. The first piece weighed 140 grams. It was put into 150° F. water. After four days, the first piece weighed 120 grams.

The second piece weighed 160 grams. It was placed in 200° F. water. After four days, the second piece weighed 130 grams.

Figure 18:
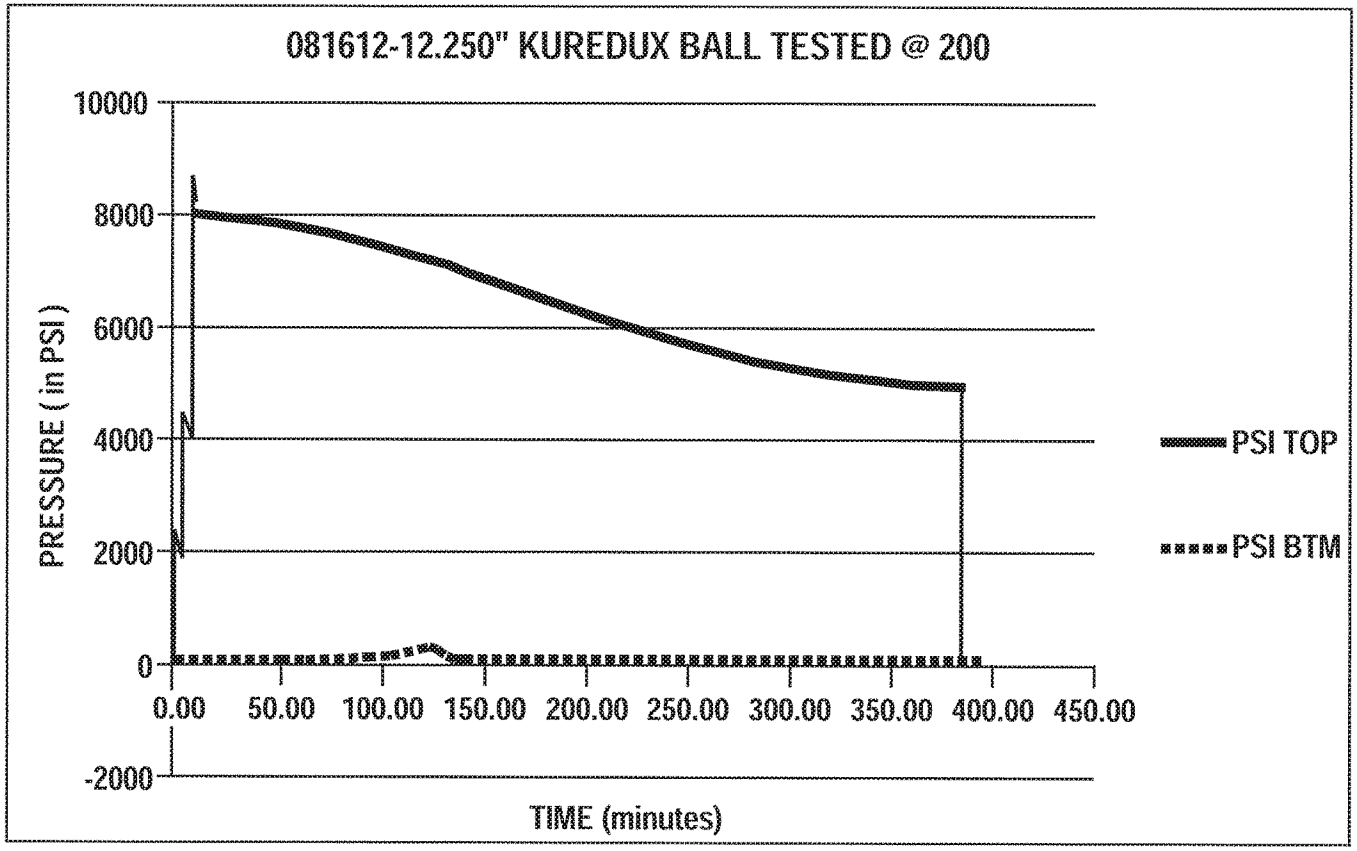
FIG. 18 is a time/pressure curve for Applicant's PGA ball to 0.25 inches in diameter taken to a pressure initially 8000 psi, held for 6 hours, and pressure released after 6 hours.

FIG. 18 illustrates pressure versus time test of a 2.25 inch PGA Kuredux® PGA resin ball at 200° F. and pressures up to 8000 indicating the period of time in minutes that the pressure was held. Psi at top and psi on bottom are both shown. The ball held at pressures between 8000 and about 5000 psi up to about 400 minutes. The test was run using a Maximater Pneumatic plunger-type, in a fresh water heat bath. The ball was placed in a specially designed ball seat housing at set temperature to 200° F. Pressure on the top side of the ball was increased at 2000 psi increments, each isolated and monitored for a 5 minute duration. Pressure was then increased on top side of the ball to 4000 psi, isolated and monitored for a 5 minute duration. Pressure was increased on the top side of the ball to 8000 psi, isolated and monitored until failure. The assembly was then bled down. There was no sign of fluid bypass throughout the duration of the hold. The top side pressure decrease see in FIG. 18 was probably caused by the ball beginning to deteriorate and slide into the ball seat. Due to the minimal fluid volume above the ball in the test apparatus, pressure loss caused by this is evident. In contrast, a well bore has relatively infinite volume versus likely ball deformation. After 6 plus hours of holding pressure without failing, top side pressure was bled down and the test completed. The ball was examined upon removal from the ball seat. It had begun to deform and begun to take a more cylindrical shape, like the ball seat fixture. While it was intended to take the ball to failure, the testing was substantially complete after 6 hours at 5000+psi.

In the absence of fluid flow adjacent the ball, the ball's temperature will be substantially determined by the temperature of the formation of the zone where the ball is seated. An increase in pressure upon the ball due to fracking may produce an increase in adjacent downhole temperature, and, in addition to other factors, such as how far removed the ball is from the fracking ports, increase downhole fluid temperature adjacent the ball. For example, increasing downhole pressure to 10,000 psi may produce a downhole fluid temperature of 350° F. and increasing downhole pressure to 15,000 psi may produce a 400° F. temperature. Because degradation is temperature dependent, higher temperatures will cause degradation to begin more quickly and for the degradable element to fail more quickly. Duration from initiation of fracking until the PGA frac ball fails will generally decrease with increasing temperature and pressure. Accordingly, for a given desired blockage duration, other conditions being equal, desired PGA frac ball diameters increase with increasing pressure and with increasing temperature.

Fluid flow of fluid from the surface adjacent to the ball typically cools the ball. Accordingly, it is believed flowing fracking fluid close to the ball, cools the ball. These are factors which the operator may consider in determining preferable ball/seat overlap and ball size for the particular operation.

Taking these factors into account in choice of frac ball size, PGA frac balls for example, are useful for pressures and temperatures up to at least 15,000 pi and 400° F., it being understood that pressure and temperature effects are inversely related to the duration of time the PGA frac ball must be exposed to the downhole fluid environment before it is sufficiently malleable and sufficiently deteriorated to pass through the seat. It is believed the PGA frac ball undergoes a change from a hard crystalline material to a more malleable amorphous material, which amorphous material degrades or deteriorates, causing the ball to lose mass. These processes operate from the ball's outer surface inward. The increasing pressure of fracking increases downhole fluid temperature and causes shearing stress on the conical portion of the ball abutting the seat. It is believed as these several processes progress, they cooperate to squeeze the shrinking, more malleable ball which is under greater shear stress through the seat. It is believed the described downhole tools comprised of the described materials will initially function as conventional downhole tools and then deteriorate as described herein. It is believed that the described several processes function together to accomplish the change from the initial hard dense frac ball blocking the well bore by sealing against the seat to the more malleable less dense frac ball which has passed through the seat, unblocking the well bore. At greater pressure and temperatures, deterioration occurs at a more rapid rate. Degradation produced by higher pressure and higher temperature for a shorter time is believed to be accomplished by processes which are similar to degradation produced at a lower pressure and lower temperature for a longer time. These are deterministic processes which produce reliably repetitive and predictable results from similar conditions. Knowledge of these processes can be used to calculate the duration for different size frac balls will pass through the seat of a plug at a particular depth, pressure and temperature. This permits the operator to select a ball, which will seal the wellbore by blocking the plug for the operators chosen duration. This is advantageous in field operations because it permits production operations to be tightly and reliably scheduled and accomplished.

The size of the ball relative to the seat is selected to produce the desired bridge plug conduit blockage duration for the particular well situation in light of the conditions where the subject bridge plug will be positioned. The lower the temperature of the formation at the location where the where the bridge plug will be used, the smaller the preferred size of the ball relative to the seat for a given desired duration of bridge plug conduit blockage. The higher the temperature of the formation where the bridge plug will be used, the larger the preferred size of the ball relative to the seat for a given desired duration of bridge plug conduit blockage. Likewise, the longer the period of time desired for the ball to block the conduit by remaining on the seat, the larger the preferred size of the ball relative to the seat for a given desired duration of bridge plug conduit blockage. The shorter the period of time desired for the ball to block conduit by remaining on the seat, the smaller the preferred size of the ball relative to the seat for a given desired duration of bridge plug conduit blockage.

FIG. 15 illustrates the ball degradation rate of a 3 inch OD PGA frac ball versus time at 275° F., the PGA ball made from 100 R60 Kuredux® PGA resin according to the teachings set forth herein. FIG. 16 shows a graph of the ball diameter degradation rate (in/hr) versus temperature relationship which illustrates that the rate of ball diameter degradation increases as temperature increases. FIGS. 17 and 17 A illustrate integrity v. diameter test results for applicant's PGA balls when subjected to pressures between 3000 to 15,000 pounds, for ball overlaps of ⅛ inches and ¼ inches. Use of the relationships shown in FIGS. 15, 16, and 17 with known formation conditions where the bridge plug will be positioned, seat size and desired duration of bridge plug conduit blockage produces a desired ball diameter for the particular formation location and task. For a given bridge plug conduit blockage duration and seat size, a greater formation temperature produces a larger desired ball diameter. For example, for a given bridge plug conduit blockage duration and seat size, the ball diameter will be larger for a 300° F. formation location than for a 225° formation location. The relationship of such conditions, relative ball and seat sizes and blockage times is taught by the disclosures herein.

Applicant's balls and methods of using them in downhole isolation operations comprise providing a set of balls to an operator which set has balls of predetermined and predefined sizes. An exemplary set of balls comprises balls within the range of 1.313 inches to 3.500 inches, which balls provide the operator with predefined and predetermined size differences, either uniform size differences or nonuniform size differences. For example, the size differences may be 1/16 inch or ¼ inch between each ball size. For example, for an exemplary useful set of balls may comprise balls sized 1.313; 1.813; 1.875; 1.938; 2.000; 2.500; 2.750; 2.813; 2.938; 3.188; 3.250; and 3.500.

Applicant's method of choosing an appropriate ball size for use with a particular isolation tool to be used at a particular depth in a particular well includes use of the decision tree disclosed herein, which decision tree for a particular operation may include consideration of some of times, pressures, temperatures, clearance through higher isolation tools with seats, and the size of the particular isolation tool's seat to determine the desired ball/seat overlap, and thus the appropriate ball size. Times may include time of the ball on the seat, fracking time, time for the ball to pass through the seat, time to substantial ball deterioration and time for substantially total ball disintegration into nontoxic byproducts. Pressures may include pressure on the ball at the particular isolation tool prior to fracking, pressure on the ball during fracking, and pressure on the ball after fracking. Temperatures may include temperature at the particular isolation tool prior to fracking, temperature at the ball during fracking, and temperature at the ball after fracking. Required clearance through the seats of higher isolation tools and consideration of the number of seats through which the ball will pass before reaching the target seat on the target isolation tool. Preferably at least about 0.4 inches of clearance will be provided between the ball and the higher seat through which the ball must pass before reaching the target seat. The size of the target seat determines the size of the ball to provide the desired ball/seat overlap, which Applicant's decision tree determines is most preferable for the particular operation. The data of FIGS. 15, 16, 17 and 17 A are used in Applicant's method of determining the appropriate ball size for the particular operation.

Applicant's preferred apparatus and method includes providing an appropriate set of balls to the operator at the well site prior to the operator needing the balls for the operation. The balls in the set of balls have predefined and predetermined sizes selected to be appropriate for the operator's needs at the specific well. Although different arbitrary sizes of balls can be provided, Applicant's method includes providing the operator with balls which have a uniform size difference between the balls and which size difference is chosen to most likely provide ball sizes appropriate for the operator's needs.

In a previous example, Kuredux® PGA frac balls are provided in sizes between 0.75 inches and 4.625 inches, to facilitate operation of frac sleeves of various sizes. In other embodiments, balls may be provided in increments from about 1 inch up to over about 7 inches. It is advantageous to provide to the operator a set of balls which have uniform incremental sizes, to ensure the operator has on hand balls appropriate to the operator's immediate needs and preferences. In some applications, ball sizes in the delivered set are preferably increased in one-eighth inch increments. In other applications, the incremental increase in ball sizes in the delivered set is preferably in sixteenths of an inch. Thus, in appropriate cases, a set of balls is delivered to the operator appropriate for fracking the desired zones with a single run of frac balls which are immediately available to the operator due to having been previously provided the operator in a predetermined set of frac balls. It is typical for an operator to frac more than 12 and less than 25 zones with a single run of frac balls. A set of PGA frac balls delivered to a well site may comprise between 10 and 50 frac balls. A preferable set of PGA frac balls delivered to a well site may comprise 12 to 25 frac balls. If the operator has on hand an appropriate set of frac balls, the operator may frac up to 63 zones with a single run of frac balls.

Other conditions and measurements being equal, smaller balls can resist more pressure for longer than larger balls having the same ball/seat overlap. In some embodiments, the overlap or difference between seat diameter and ball diameter may be about ⅛ inch or about ¼ inch. In one embodiment, the balls at or over 3" in diameter have about ¼ inch smaller seats, and those under 3" in diameter have about ⅛ inch difference. If a time longer than about 10-15 hours until frac completion and/or downhole temperature conditions exceed about 275°, then ball diameters, and overlap of the ball over the seat, may be increased accordingly to increase the duration of the ball on the seat.

The operator, being aware of depths and formation conditions at each of the isolation plug locations in the wellbore, and deciding upon how many isolation plugs are to be used to produce the well, determines desired ball sizes and seats for each of the isolation plugs to be used in the well from the balls available in the set of balls at the well site using the methods described herein. Upon determining desired ball sizes for the several isolation plugs from the immediately available set of preselected and predetermined balls, the operator uses the disclosed decision tree factors to determine the appropriate ball for each isolation plug from the preselected appropriate set of balls, and uses each chosen ball for its target seat in its target isolation valve in the fracking or other isolation tool operation at each target formation location. This method of having a pre-delivered set of balls appropriate for the well at the well site, and method for selecting appropriate balls from the pre-delivered set of balls provides the operator with a convenient, timely and efficient method for having appropriate balls immediately available, determining ball sizes appropriate for production operations at the well, selecting appropriate balls from the set of balls, and using them in the production operation at the well.

In some embodiments of some isolation valves, such as a frac sleeve, multiple balls are used with the isolation tool. For example, some tools require four frac balls to operate a frac sleeve. In those cases, a plurality of identically sized PGA frac balls, 110 are provided and available and are used.

Figure 19A:
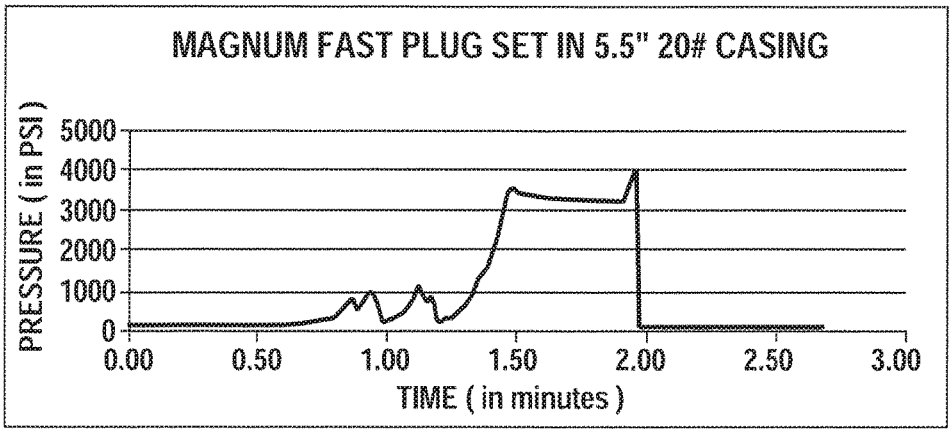
FIGS. 19A and 19B show pressure set and pressure tests of a PGA composite downhole tool.

FIG. 19 illustrates a structural diagram of a 5% inch snub nose ball drop valve with the item numbers listed as item number 1 to 15 for this Figure only.

5½ Inch Snub Nose Structural Integrity Test

Figure 19B:
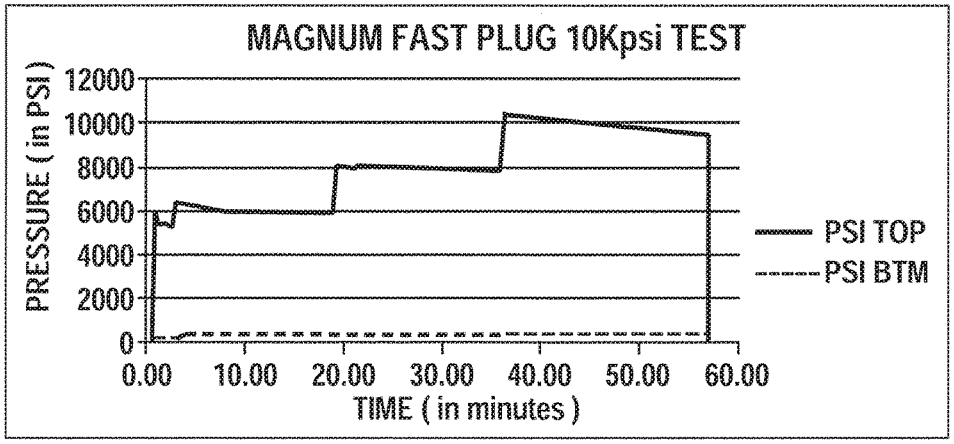

A 5½ inch snub nose was tested in a 48 inch length tubing. The test used a single pack-off element with bottom shear at about 32,000 lbs. The PGA elements of this tool were: mandrel part 1, load ring part 2, cones part 4, and bottom part 7 (7*a* and 7*b*), the part numbers being as identified on FIG. 19 and being used for FIG. 19 only. A Maximater Pneumatic plunger-type pump was used with fresh water in a Magnum heat bath. Plug set and tested at ambient temperature. The plug was set in a casing (FIG. 19A), and drop ball and pressure increased at top side to 5000 psi to ensure no leaks. Pressure was increased at top side to 6000 psi, isolated and monitored for 15 minutes. Pressure increased at top side to 8000 psi, isolated and monitored for 15 minutes. Pressure increased at top side to 10,000 psi, isolated and monitored for 20 minute duration (FIG. 19B). Bleed assembly pressure, all testing completed. The top slip engagement was 835.9 psi/6018 lbs. The bottom slip engagement was 1127 psi/8118 lbs. The plug shear, 4370 psi/31,469 lbs.

Once the plug was assembled and installed on the setting tube, it was lowered into the 5.5 inch, 20 lb. casing. The setting process then began. The plug was successfully set with a 31.5 K shear. A ball was dropped onto the mandrel and the casing was pumped into the test console. Top side pressure was then increased to 5000 psi momentarily to check for leaks, either from the test fixture or the pressure lines. No leaks were evident and the top side pressure was then increased to 6500 psi for 15 minute duration. Pressure was then increased top side to 8000 psi for 15 minute duration. Upon completion of the 8000 psi hold, pressure was increased top side 10,000 psi for a 20 minute duration. Minimal pressure loss was evident on the top side of the plug. This is attributed to additional pack-off and mandrel stroke due to the fact that no sign of fluid bypass was evident on the bottom side of the plug. Total fluid capacity of the casing was less than 2.5 USG, pressure loss evident top side at the plug totaled less than 1 cup. Assembly pressure was then bled down and testing was completed.

Upon removal of the test cap, there was no sign of eminent failure. The slips had broken apart perfectly and were fully engaged with the casing wall. There was also no sign of element extrusion or mandrel collapse. Everything performed as designed. Similar testing was done on a 4½ inch plug with similar results.

Set forth in FIGS. 1-14 and 19 above are various embodiments of down hole tools. In some embodiments of the above described plugs and in the ball drop bridge plug and snub nose bridge plug, there are at least the following elements: a mandrel, a cone, a top and bottom load ring, and a mule shoe or other structural equivalents, of which one or more of such structures may be made from the PGA or equivalent polymer disclosed herein. Other elements of the plugs typically not made from PGA, and made at least in part according to the teachings of the prior art are: elastomer elements, slips, and shear pins. Some prior art downhole tools, not made of PGA, must be milled out after use. This can cost time and can be expensive. For example, using PGA or its equivalent in the non-ball and, in some embodiments, non-seat, structural elements of the plugs, in addition to using a PGA ball if applicable or desired, results in the ability to substantially forego milling out the plug after it is used. Due in part to PGA disintegration according to the teachings set forth herein, at the described time/temperature conditions, as well as in still fluid down hole conditions (substantially non-flow conditions), Applicant has achieved certain advantages, including functionally useful, relatively quick, degradability/disintegration of these PGA elements in approximately the same time, temperature, and fluid environmental conditions of Applicant's novel frac ball as set forth herein.

In one preferred embodiment of the down hole tool structural elements made from PGA substantially degrade to release the slips from the slip's set position in a temperature range of about 136° to about 334° F. in between one to twelve hours, in a substantially non-fluid flow condition. The fluid may be partially or substantially aqueous, may be brine, may be basic or neutral, and may be at ambient pressure or pressures. Maximum pressure varies according to the structural requirements of the PGA element as shown by the pressure limitation curve of FIG. 17 and as can be inferred by its teaching.

Some prior art degradable downhole tool elements, upon dissolution, leave behind incrementally unfriendly materials, some in part due to the fluids used to degrade the prior art elements.

In downhole use of downhole tool elements comprised of PGA as described herein, the PGA elements initially accomplish the functions of conventional non-PGA elements and then the PGA elements degraded or disintegrated into non-toxic to humans and environmentally-friendly byproducts as described herein.

As set forth herein, when the above described downhole tool elements or other downhole tool elements comprised of PGA and its equivalents are placed within the above conditions, they will typically first perform their conventional downhole tool element function and then undergo a first breakdown. This first breakdown loosens and ultimately releases the non-PGA elements of the plug from the PGA elements of the plug. This includes release of the slips which press against the inner walls of the production tubing to hold the downhole tool in place. Release of the slips permits displacement of down hole tool through the well bore. Typically, continued downhole degradation then results in substantial breakdown of the PGA elements into materials which are non-toxic to humans and environmentally friendly compounds. For example, in typical down hole completion and production environments, and the fluids found therein, PGA will break down into glycerin, CO2 and water. These are non-toxic to humans and environmentally friendly. The slips are usually cast iron, shear pins usually brass, and the elastomer usually rubber. However, they may be comprised of any other suitable substances. These elements are constructed structurally and of materials known in the prior art.

Some prior art downhole tool elements must be mechanically removed from the well bore, such as by milling them out or retrieving them. The described PGA element does not need to be mechanically removed. Some prior art downhole tool elements require a turbulent flow of fluid upon them for them to degrade or deteriorate. The described PGA elements degrade or deteriorate in the presence of still downhole fluid. The described PGA elements primarily only require the presence of a heated fluid to begin deteriorating. This is a substantial advantage for PGA-comprised downhole tool elements.

Some prior art degradable downhole tool elements require a high or low PH fluid or require a solvent other than typical downhole fluid to promote degrading. The described PGA elements degrade or deteriorate in the presence of typical hot downhole fluid and without the necessity of a high or low PH fluid or a solvent other than typical hot downhole production fluid. Fluids the described GPA material degrades in include hydrocarbons, water, liquid gas, or brine. In one embodiment, no other substances, for example, metals or ceramics, are mixed with the PGA in the element. PGA has been found to degrade in non-acidic oil, liquid gas, brine or any typical down hole fluid without needing a significant turbulent flow of the down hole fluid in the proximity of the structure element to begin the disintegration. It is especially useful that acidic fluids are not necessary for its disintegration.

This is advantageous because some prior art elements are primarily only quickly dissoluble down hole in the presence of a substantial flow of down hole fluid or in the presence of acidic fluids, conditions which require use of coiled tubing or other tool and activity to create conditions for degrading their elements. The disclosed embodiment is advantageously used to perform its mechanical functions and then degrade without further investment of time, tools or activity.

The PGA downhole elements described herein are advantageously stable at ambient temperature and substantially stable in downhole fluid at downhole fluid temperatures of up to about 136° F. PGA downhole elements begin to degrade or deteriorate in downhole fluid at downhole temperatures of above 136° F., and preferably in the range of from 150° F. to 300° F. Fracking operations pressurize the downhole fluid, and the higher pressures cause higher temperatures. Thus, the PGA element has the strength and incompressibility to be used as a conventional downhole tool element in the high pressure of fracking operation, and the high pressure of fracking causes the downhole fluid temperature to rise, which high downhole fluid temperature initiates degradation of the PGA element which allows production of the well without drilling out or retrieving the tool.

The predictable duration of time between PGA elements being immersed in the drilling fluid and the elements degrading is a useful function of the described element. The described PGA elements sufficiently degrade or deteriorate after their fracking function is completed so they fail their convention tool element function and production can proceed without being impeded by the elements remaining in the bore hole within about five hours to about two days. For example, a preferred time for PGA frac balls to fail by passing through their ball seat is from between about five to six hours to about two days. The time to failure is determinable from the teachings herein and experience.

In one aspect, a machinable, high molecular weight hydrocarbon polymer of compressive strength between about 50 and 200 MPa (INSRON 55R-4206, compression rate 1 mm 1 min, PGA 10.times.10.times.4 (mm), 73.degree. F. to 120.degree. F.) may be used as the precursor or substrate material from which to make or prepare plug balls, mandrels, cones, load rings, and mule shoes or any of those parts degradable in typical downhole fluids in high pressure and temperature conditions. In another aspect, one or more of such elements of a downhole plug will decay faster than typical metallic such elements, typically within several days after being placed within the downhole environment. In a more specific aspect, the polyglycolic acid as found in U.S. Pat. No. 6,951,956, may be the polymer or co-polymer and used as the substrate material, and may include a heat stabilizer as set forth therein. Polyglycolic acid and its properties may have the chemical and physical properties as set forth in the Kuredux® Polyglycolic Acid Technical Guidebook as of Apr. 20, 2012, and the Kuredux® PGA Technical Information (Compressive Stress) dated Jan. 10, 2012, from Kureha Corporation, PGA Research Laboratories, a 34-page document. Both the foregoing Kureha patent and the Kuredux® technical publications are incorporated herein by reference. Kuredux® PGA resin is certified to be a biodegradable plastic in the United States by the Biodegradable Plastics Institute and is a fully compostable material satisfying the ISO 14855 test protocol.

In a preferred embodiment, Applicant prepares the structural elements of downhole isolation tools comprising, without limit, the mandrel, load rings, cones, and mule shoes from Kuredux® 100R60PGA resin. This is a high density polymer with a specific gravity of about 1.50 grams per cubic centimeter in an amorphous state and about 1.70 grams per cubic centimeter in a crystalline state, and a maximum degree of crystallinity of about 50%. In a preferred embodiment, the Kuredux® is used in pellet form as a precursor in a manufacturing process, which includes the steps of extruding the pellets under heat and pressure into a cylindrical or rectangular bar stock and machining the bar stock as set forth herein. In one embodiment of a manufacturing method for the structural elements that use the polymer and, more specifically, the PGA as set forth herein, extruded stock is cylindrically shaped and used in a lathe to generate one or more of the structural elements set forth herein.

The lathe may be set up with and use inserts of the same type as used to machine aluminum plug elements or downhole parts that are known in the art. The lathe may be set up to run and run to a depth of about 0.250 inches. The lathe may be set to run and run at an IPR of 0.020 inches (typically, 10-70% greater than used for aluminum), during the roughing process. The roughing process may run the PGA stock dry (no coolant) in one embodiment and at a spindle speed (rpm) and a feed rate that are adjusted to knock the particles into a size that resembles parmesan cheese. This will help avoid heat buildup during machining of the structural elements as disclosed herein.

In a finishing process, the IPR may be significantly reduced, in one method, to about 0.006 inches, and the spindle speed can be increased and the feed rate decreased.

In one or more aspects of this invention, the structural elements of the plug and the ball are made from a homogenous, non-composite (a non-mixture) body configured as known in the art to achieve the functions of a ball in one embodiment, a mandrel in another, support rings in another, and a mule shoe in another. This homogenous, non-composite body may be a high molecular weight polymer and may be configured to degrade in down hole fluids between a temperature of about 136° F. and about 334° F. It may also be adapted to be used with slip seals, elastomer elements, and shear pins, as structurally and functionally found in the prior art, and made from materials found in the prior art.

In certain aspects of Applicant's devices, the homogenous, non-composite polymer body will be stable at ambient temperatures and, at temperatures of at least about 200° F. and above, will at least partially degrade to a subsequent configuration that unblocks a down hole conduit and will further subsequently degrade into products harmless to the environment.

PGA is typically a substantial component of these structural elements and, in one embodiment, homogenous. Generally, it has tensile strength similar to aluminum, melts from the outside in, is non-porous, and has the crystalline-like properties of incompressibility. Although this disclosure uses specific PGA material and specific structural examples, it teaches use of materials other than PGA materials which degrade or deteriorate in similar downhole conditions or conditions outside the particular range of PGA. It further teaches that downhole tools of various structures, functions, and compositions, whether homogeneous or heterogeneous, may be usefully used within the scope of the disclosure to obtain the described useful results.

In one embodiment, heat stabilizers are added to the PGA or other substrate material to vary the range of temperatures and range of durations of the downhole tool element's described functions. Greater downhole depths and fracking pressures produce greater downhole fluid temperatures. An operator may choose to use the described degradable elements, modified to not begin degrading as quickly or at as low a temperature as described herein. Addition of a heat stabilizer to the PGA or other substrate material will produce this desired result.

Although some of the described embodiments are homogenous (non-composite), the downhole elements may be heterogeneous. Fine or course particles of other materials can be included in a substrate admixture. Such particles may either degrade more quickly or more slowly than the PGA or other substrate material to speed or slow deterioration of the downhole elements as may be appropriate for different downhole conditions and tasks. For example, inclusion of higher melting point non-degradable material in a PGA ball is expected to delay the ball's passage through the seat and delay the ball's deterioration. For example, inclusion of a heat stabilizer in a PGA ball is expected to delay the ball's passage through the seat and delay the ball's deterioration. For example, inclusion of materials which degrade at temperatures lower than temperatures at which PGA degrades or which degrade more quickly than PGA degrades is expected to speed a ball's passage through the seat and speed a ball's deterioration. These teachings are applicable to the other downhole elements described herein and to other downhole tools generally.

The predictable duration of time from the temperature initiated deterioration beginning to degrade the element sufficiently that it fails, cases to perform its conventional tool function, under given conditions as taught herein is advantageous in field operations. The degradable element's composition, shape, and size can be varied to obtain a reliable desired duration of time from temperature-initiated deterioration to tool failure. In an embodiment, there are one or more coatings on the element, for example, latex paint. These coatings may be used to predictably extend the time to the element's malleability and functional dissolution.

Figure 20:
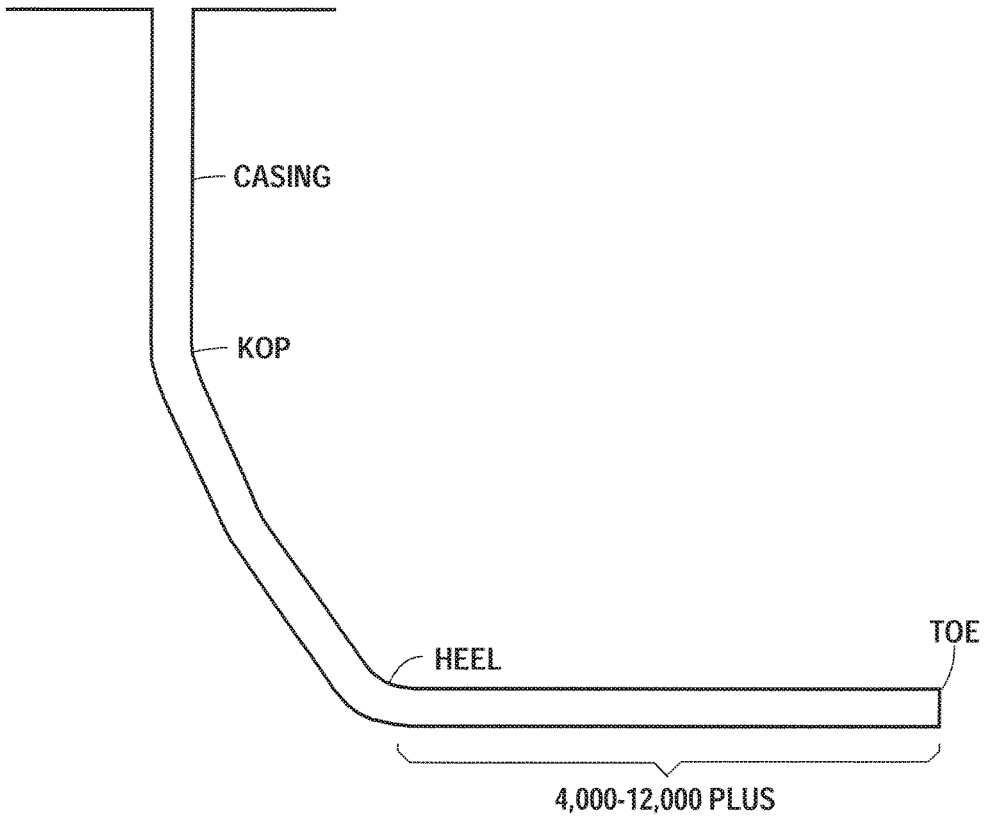
FIG. 20 is a schematic cross-sectional view of an exemplary environment showing a wellbore casing extending into a subterranean hydrocarbon formation.

As seen in FIG. 20, an exemplary extended reach lateral well may have about 4-12,000 feet or more of lateral reach between the heel and toe. It may have a total vertical depth of about 13-19,000 feet or more. Such an exemplary well may have a total measured depth ("TMD") of between about 15,000 and 23,000 feet or more. FIG. 20 illustrates an extended reach lateral well that may use any of the embodiments of devices and inventions set forth herein, in one case, frac plugs to isolate hydrocarbon formations in multi-stage frac operations in horizontal wells.

It is well known to use one type of isolation plug and one type of isolation plug removal process to bring a well into production. Extended reach wells present additional considerations. Coil tubing may be used to set or drill out conventional plugs ("Cp") (that is, plugs with non-degradable elements) up to about 19,000' TMD, with increasing difficulty and expense beyond about 15,000'. Drilling out plugs with coiled tubing near the toe may be difficult in extended reach applications. A different method is: (1) using conventional plugs through about 15,000' to 19,000' and drilling out those conventional plugs, and (2) using plugs with degradable elements as set forth herein beyond about 15,000', typically out to about 19,000' and leaving the plugs with degradable elements to degrade is a beneficial and cost effective method for bringing a well into production.

A method is provided for (1) setting, using and drilling out conventional plugs from the surface through about 15,000, typically out to about 19,000 feet, and (2) setting, and using (for fracking in one instance) plugs with degradable elements, including, for example, elements made of PGA, from about 15,000 to 19,000 feet and up to the toe, and leaving the plugs with degradable elements to degrade, rather than drilling them out.

In another embodiment, conventional plugs are set, used, and drilled out to a TMD of about 20,000 feet. Beyond that depth, degradable plugs or ball/plug combinations as set forth herein are used. Following use, such as in fracking, the conventional plugs Cp are drilled out in ways known in the art and the degradable plugs are left to dissolve.

In one test, a snub nose plug 700 (see FIG. 7) was provided with all elements of the plug except for the slips and rubber (elastomer) being made of PGA. The plug was tested under the following conditions: 200° F., 3,500 psi, @ 9:00 hours. The results were the plug "let go" or quit holding pressure after 9:00 hours @ about 200° F.

In an alternate embodiment, Applicants use the combination of (1) a low metallic content easily drilled out composite plug or a conventional plug in an upper portion of the well with (2) plugs with degradable elements according to any of the embodiments set forth herein in a lower portion of the well. In the alternate embodiment, a ball drop plug can be used wherein the ball is a degradable ball, for example, a PGA ball as described herein, along with a composite or conventional plug, wherein the ball disintegrates over time due to heat and fluid contact. The remaining composite plug may be either left in the well or may be drilled out at a later more convenient time. In a preferred embodiment, the plugs used in the extended reach have a minimum inner diameter of 0.50 inches.

In another embodiment, an entire well is fracked using only frac plugs as disclosed herein, that is, plugs which are at least partially comprised of degradable materials, or are conventional frac plug designs using degradable balls or plug elements. In the embodiments set hereinabove, the well typically has a horizontal portion.

Figure 21A:
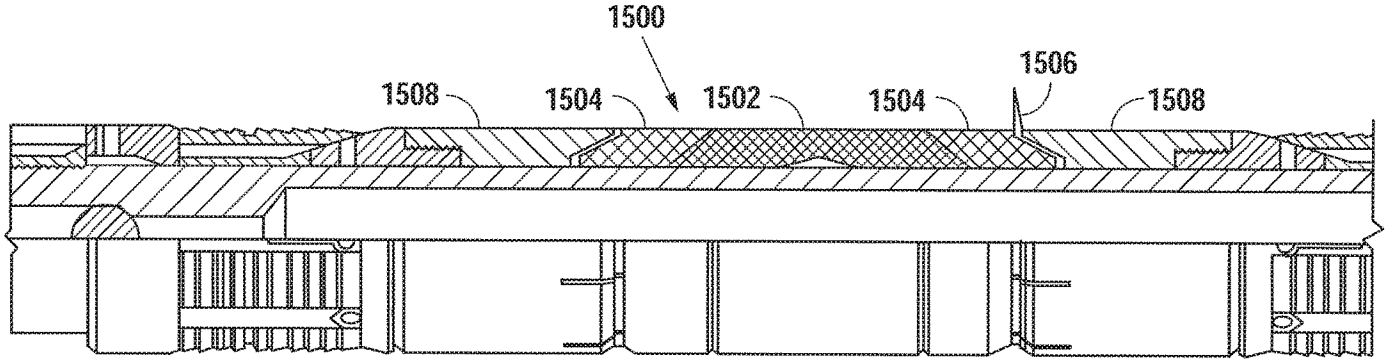
FIGS. 21A and 21B illustrate cross-sectional/exterior views of a downhole tool having degradable elastomeric elements.
Figure 21B:
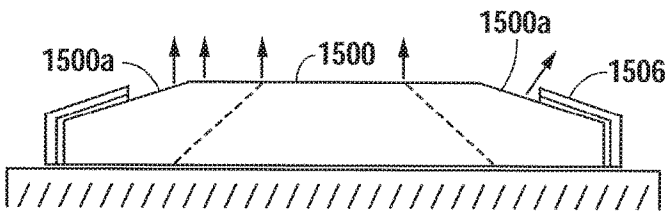

FIGS. 21A and 21B illustrate the use of elastomeric elements in downhole plugs. In ways known in the art, plugs are set by setting tools, driving cones, and applying compression to elastomeric elements so they expand against the inside wall of downhole casings, which sets the plug. Non-degradable elastomeric elements are known in the art. For example, Nitrile having a Shore A durometer hardness of between 60 and 90 is available from variety of rubber vendors. However, typical elastomeric expandable setting elements do not quickly break down or degrade downhole and may clog or interfere with fluid circulation and production. Applicants provide, in FIGS. 21A and 21B, elastomeric elements 1500 designed to degrade into environmentally harmless elements within days, months or years of their placement downhole. The dimensions of Applicant's degradable elastomeric elements 1500 may be the same or similar to those in the prior art, their novelty being primarily in their predetermined temporal degradability. For example, in FIG. 21A, degradable elastomeric element 1500 is comprised of three pieces, center element 1502 and end elements 1504. In FIG. 21B, the degradable element is a single piece.

The breakdown times of the described degradable elastomeric element will vary according to local conditions and elastomeric element composition. One useful result is sufficient elastomeric element degradation within a predetermined time such that it fragments into smaller pieces which may be more easily circulated out or which do not materially interfere with circulation or production. Useful predetermined times for the elastomeric element to break into smaller pieces are within 48 hours, one week, one month or more. This avoids elastomeric elements in the well interfering with production.

A rigid durable strong anti-extrusion (anti-deformation) base or member 1506 may be provided adjacent either end elements or either ends of the one-piece element illustrated in FIG. 21B, the anti-extrusion members 1506 being configured to lay adjacent the perpendicular end walls of the element and at least partially adjacent the conical side walls 1500*a*. Compression of the elastomer 1500 by elements on either side in ways known in the art causes cone or cones 1508 to push the elastomer outward and against the inner walls of the wall casing. Anti-extrusion base or member 1506 forces the elastomer top to expand in the directions indicted by the arrows in FIG. 21B rather than bulging sideways.

The material or materials that may, in one embodiment, comprise Applicant's biodegradable elastomer may be found in Publication US 2011/0003930, incorporated herein by reference, which discloses an elastomeric polymeric material having a hardness from 50 on the Shore A scale to 65 on the Shore D scale. It discloses a biodegradable elastomer compound with suitable hardness. The elastomer may be molded, over-molded or extruded.

Another degradable material of sufficient strength and hardness may be found in U.S. Pat. No. 7,661,541, incorporated herein by reference. This patent discloses the use of polymers alone, as co-polymers or blends thereof, the selection of which polymer combinations will depend on the particular application and include consideration of factors such as tensile strength, elasticity, elongation, modulus, toughness, and viscosity of liquid polymer, to provide the desired characteristics.

The '541 patent discloses both polyether polyurethanes and polyester polyurethanes elastomeric biodegradable elements suitable for use in downhole tools. The degree of biostability as well the mechanical characteristics can be modified by, for example, varying the molecular weight of the polymers and using techniques and designs known in the art of, for example, biodegradable elastomers for medical use. Some commercial available segmented polyurethanes as disclosed in the '541 reference are: Biomer™ (Ethicon Inc., Somerville, N.J.); Pellethene™ (Dow Chemical, Midland, Mich.); and Ticoflex™ (Carmedix, Inc., Wolbang, Mass.). Of these, the Pellethene in particular (including a number of embodiments of Pellethenee) may be designed with the mechanical characteristics and hardness, as well as elastomeric and biodegradable properties, needed for use as a degradable elastomer in downhole tools.

Prior art elastomers typically have hardnesses of about 60 to 95, in either a single elastomer or segmented (three part) elastomer as illustrated. However, in one embodiment, Applicant's degradable elastomer initially has the mechanical and dimensional characteristics of prior art elastomers, and is, in one embodiment, in a durometer range of about 40 to 60 Shore A, and uses the anti-extrusion base or member 1506 as illustrated. In another embodiment it may be in the hardness range of 40 to 95 Shore A. Both suitable biodegradable elastomers may be found in U.S. Pat. Nos. 4,045,418; 4,047,537; and 4,568,253, all of which are incorporated herein by reference. These disclose elastomers with appropriate hardness and provide thermoplastic biodegradability in an elastomer that may be deformed under the compression conditions of downhole tools.

Figure 22A:
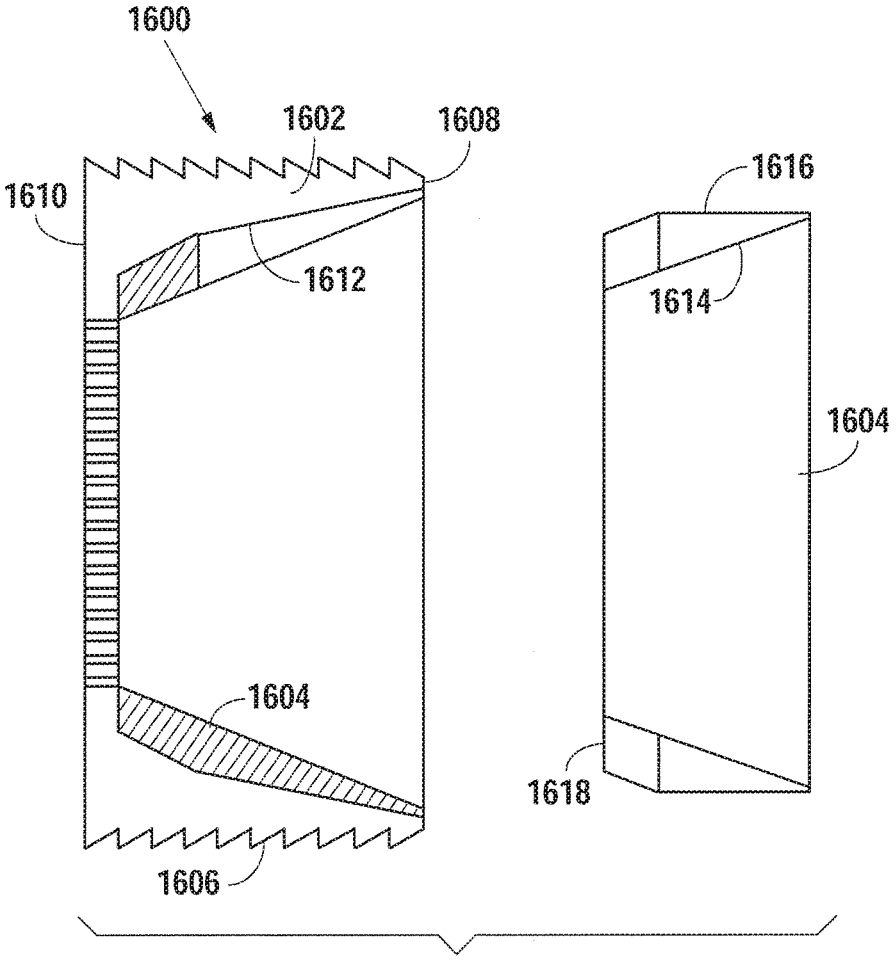
FIG. 22A is a cross-sectional view showing the combined slip on the left, with the degradable portion only shown on the right.
Figure 22B:
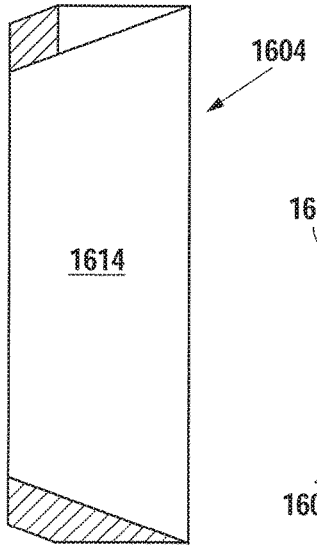
FIG. 22B is a cross-sectional view of the degradable portion of the slip.
Figure 22C:
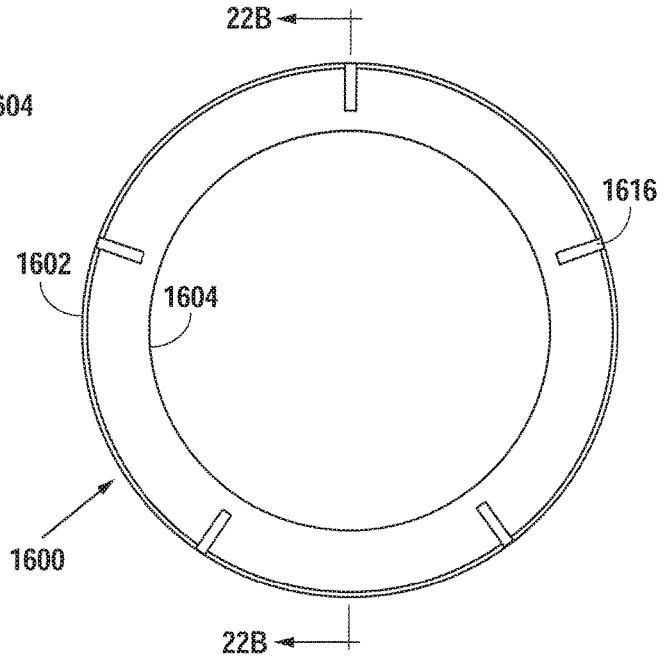
FIG. 22C is a front elevational view of the slip having degradable and non-degradable components.

FIGS. 22A, 22B, 22C, and 22D illustrate a multi-component slip 1600 that may be made of a metallic component 1602, such as steel or cast iron, typically comprising the outer portion of the multi-component 1600, and a non-metal, degradable component 1604 typically comprising all or a portion of the inner walls of the multi-component slip as seen in FIG. 22A. FIG. 22A is an exploded figure showing the at least two components together on the left and exploded out to the right showing the non-metallic degradable component 1604.

Applicant's multi-component slips 1600 are designed typically with the same dimensions and functionality of prior art slips, but having degradable component 1604, including at least a portion of the inner walls of the multi-component slip allows for quicker tool breakdown and less debris remaining in the casing.

One or more of teeth 1606, leading edge 1608, and base 1610 may be at least, in part, a metallic element, such as iron or tungsten carbide. Some of inner walls 1612 may comprised of the degradable component 1604 and typically have at least partially conical walls 1614 that will function normally as conical inner walls of a slip to drive teeth 1606 into the inner walls of the casing. Yet they will decompose or degrade in fluid at the pressures and temperatures found in especially deep or long reach wells where milling out is difficult. Slots 1616 and reciprocal ridges may be provided in at least a portion of degradable component 1604 and metallic component 1602. Degradable component 1604 may have a base 1618 with an inner diameter configured to slidingly engage the mandrel or other structural member.

Figure 22D:
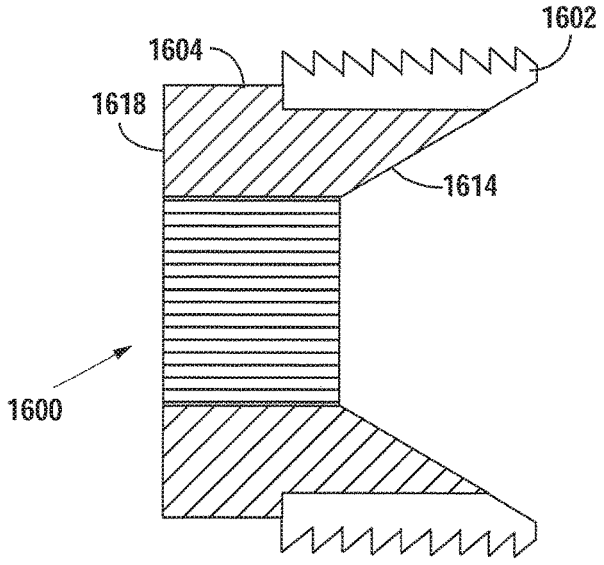
FIG. 22D is a cross-sectional side view of another embodiment of a slip having metallic and degradable parts or portions.

FIG. 22D illustrates an alternate preferred embodiment of multi-component slip 1600 showing a base configured to extend past the trailing edge of the metal component and with inner walls configured to at least partially ride on the mandrel and inner walls that are least partially conical.

The degradable material may be non-metallic, homogenous, and may be polyglycolic acid as set forth herein or any other suitable degradable material. The degradable material will degrade in fluid (including acidic or non-acidic fluid) at the downhole temperature and conditions described herein and detach from metallic component 1602, to leave only the metallic elements remaining on the slip. The degradation into smaller fragments is accomplished within a predetermined time, such as one day, one week, one month or more, which do not substantially interfere with producing the well. In an alternate embodiment, the material is not degradable, but it is a substantially non-metallic composite fiber, such as a spun filament and resin composition, such as is available from Columbia Industrial Plastics of Eugene, Oreg. It may be machined or molded onto the slip. The degradable/composite element may be separately machined and glued to the metallic elements of the slip by a suitable adhesive. In another embodiment, a tongue and groove may be used to engage the at least two components. The degradable or drillable non-metallic supporting element of the slip supporting metallic component 1602 reduce the problems caused by hard metallic slips in the well.

Figure 23C:
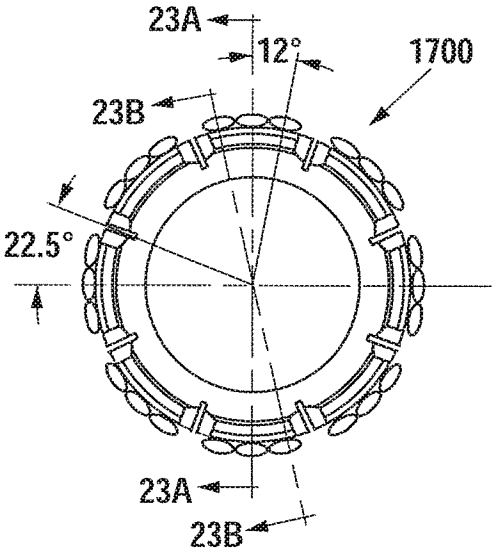
FIGS. 23A, 23B, and 23C illustrate two cross-sectional views and a front elevational view of another embodiment of a slip comprising non-degradable metallic teeth inserts in a degradable body.
Figure 23B:
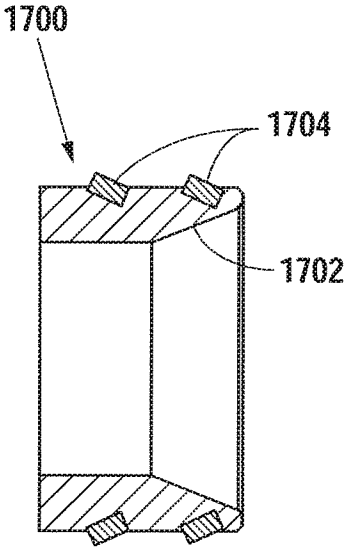
Figure 23A:
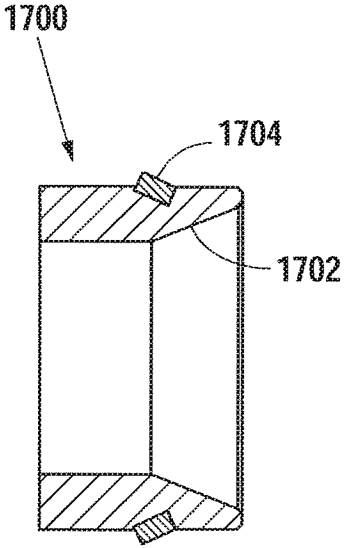

FIGS. 23A, 23B, and 23C provide views of a novel slip comprising a degradable slip body 1702, which is configured to receive multiple inserts 1704, such as insert 1704 comprising carbide, iron, tungsten carbide, ceramic mixes or other hard materials known in the art. The inner walls of degradable body 1702 may be configured in ways known in the art, typically including a conical section and a cylindrical mandrel engaging section.

Figure 24A:
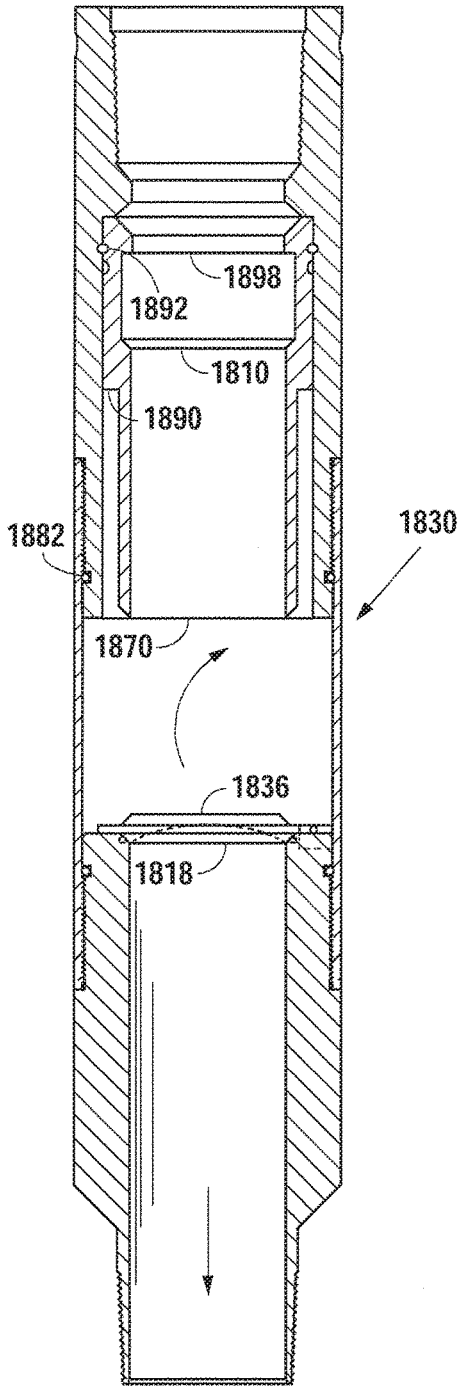
FIGS. 24A and 24B are cross-sectional views of a flapper valve assembly with the flapper valve in a closed or down position FIG. 24A.
Figure 24B:
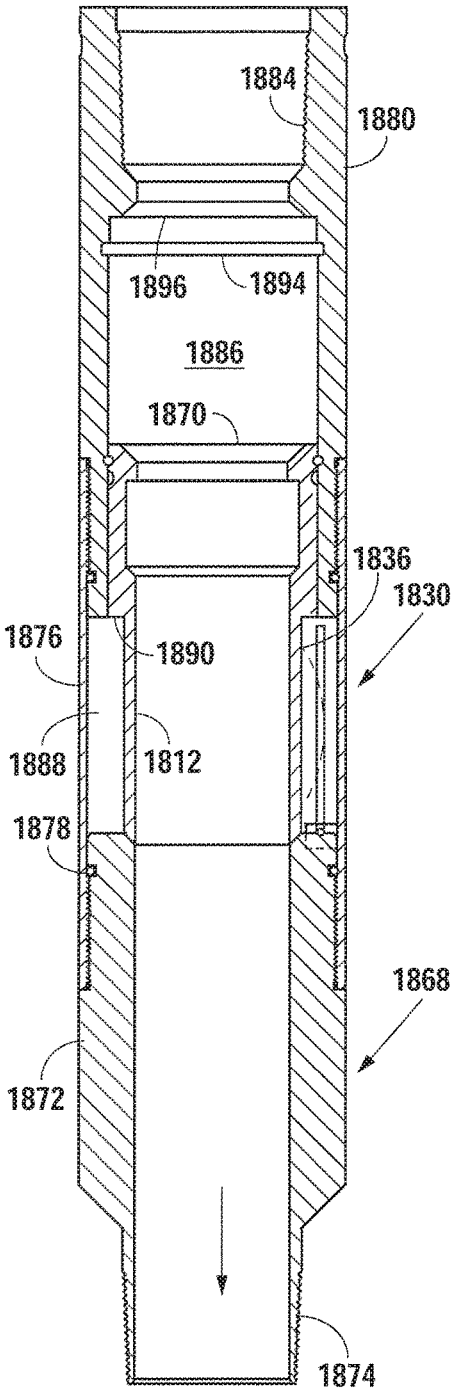

Referring to FIGS. 24A and 24B, there is illustrated an exemplary flapper valve assembly 1830 that may be used as described above in connection with vertical or horizontal wells. The flapper valve assembly 1830 comprises, as major structural members, a tubular housing or sub 1868, a flapper valve member 1836 and a sliding sleeve 1870 or other suitable mechanism for holding the valve member 1836 in a stowed or inoperative position. Any conventional device may be used to shift the sliding sleeve 1870 between the position shown in FIG. 24A where the valve member 1836 is held in an inoperative position to the position shown in FIG. 24B where the valve member 1836 is free to move to a closed position blocking downward movement of pumped materials through the flapper valve assembly 1830. Although the mechanism disclosed to shift the sleeve 1870 is mechanical in nature, it will be apparent that hydraulic means are equally suitable.

A tubular housing 1868 comprises a lower section 1872 having a threaded lower end 1874 matching the threads of the collars in casing strings 1822, 1848, a central section 1876 threaded onto the lower section 1872 and providing one or more seals 1878 and an upper section 1880. The upper section 1880 is threaded onto the central section 1876, provides one or more seals 1882 and a threaded box end 1884 matching the threads of the pins of pipe joints 1824, 1850. The upper section 1880 also includes a smooth walled portion 1886 on which the sliding sleeve 1870 moves.

The function of the sliding sleeve 1870 is to keep the flapper valve member 1836 in a stowed or inoperative position while the casing string is being run and cemented until such time as it is desired to isolate a formation below the flapper valve member 1830. There are many arrangements in flapper valves that are operable and suitable for this purpose, but a sliding sleeve is preferred because it presents a smooth interior that is basically a continuation of the interior wall of the casing string thereby allowing normal operations to be easily conducted inside the casing string and it prevents the entry of cement or other materials into a cavity 1888 in which the valve member 1836 is stowed.

The sliding sleeve 1870 accordingly comprises an upper section 1890 sized to slide easily on the smooth wall portion 1886 and provides an O-ring seal 1892 which also acts as a friction member holding the sleeve 1870 in its upper position. The upper section 1880 of the tubular housing and the upper section 1890 of the sliding sleeve 1870 accordingly provide aligned partial grooves 1894 receiving an O-ring seal 1892. When the sleeve 1870 is pulled upwardly against the shoulder 1896, the O-ring seal 1892 passes into a groove 1894 and frictionally holds the sleeve 1870 in its upper position.

The upper section 1890 of the sliding sleeve 1870 provides a downwardly facing shoulder 1998 and an inclined upwardly facing shoulder 1810 providing a profile for receiving the operative elements of a setting tool of conventional design so the sliding sleeve 1870 may be shifted from the stowing position of FIG. 3 to the position of FIG. 4, allowing the valve member 18356 to move to its operative position.

The siding sleeve 1870 includes a lower section 1812 of smaller external diameter than the upper section 1890 thereby providing the cavity 1888 for the flapper valve member 1836. In the down or stowing position, the sliding sleeve 1870 seals against the lower section 1872 of the tubular housing 1868 so that cement or other materials do not enter the cavity 1888 and interfere with operation of the flapper valve member 1836.

The flapper valve member 1836 and any or all of the structural elements of the flapper valve assembly 1830 may be made of any of the degradable materials disclosed herein, including polyglycolic acid. Further details of the structure and function of the flapper valve assembly may be found in U.S. Pat. No. 7,287,596, incorporated herein by reference. Use of a flapper valve member which degrades advantageously eliminates the need to mechanically remove the flapper valve member, such as with a rod, ball or drilling out.

In specific embodiments, the structural elements set forth herein are configured to be made from a high molecular weight polymer, including repeating PGA monomers include the tools seen in FIGS. 1-14 or FIG. 19, or those set forth in Magnum Oil Tools International's Catalog, on pages C-1 through L-17, which are incorporated herein by reference.

While measured numerical values stated here are intended to be accurate, unless otherwise indicated the numerical values stated here are primarily exemplary of values that are expected. Actual numerical values in the field may vary depending upon the particular structures, compositions, properties, and conditions sought, used, and encountered. While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

The invention claimed is:

1. A settable downhole tool for use in a hydrocarbon well with casing to engage the casing and temporarily isolate an upper zone above the tool from a lower zone below the tool, so the upper zone can be fracked in isolation from the lower zone, the tool comprising:

a mandrel comprising hard solid-state high-molecular-weight polyglycolic acid which has at least short-term stability in ambient conditions, a longitudinal passage therein and a ball seat;

a frac ball comprised of hard solid-state high-molecular-weight polyglycolic acid capable of being pumped down the well from the surface with a wellbore fluid, the ball capable of seating securely into the ball seat to block the passage;

the tool is capable of engaging the casing and being used in a hydraulic fracking operation as a conventional settable zonal isolation downhole tool; the ball in the ball seat having sufficient compression resistance and structural integrity to be capable of causing the tool to isolate the upper zone from the lower zone so the upper zone can be fracked in isolation from the lower zone;

the ball is capable of losing sufficient compression resistance and structural integrity within less than two days from being pumped down the well responsive to hydrostatic pressure from above the ball due to the ball degrading in the wellbore fluid to pass through the ball seat, causing the tool to cease isolating the upper and lower zones from each other without drilling out the tool;

the tool is capable of releasing from the tool's engagement with the casing without drilling out the tool within less than two days of the mandrel's entry into the wellbore fluid due to the tool degrading in the wellbore fluid; and the tool is capable of degrading in the wellbore fluid enough to not obstruct production of hydrocarbons from the well without drilling out the tool.

2. The tool of claim 1, wherein the hard solid-state high-molecular-weight polyglycolic acid is prepared from an at least partially crystalline polyglycolic acid, wherein (a) a difference (Tm−Tc2) between the melting point Tm defined as a maximum point of an endothermic peak attributable to melting of a crystal detected in the course of heating at a heating rate of 10° C./min by means of a differential scanning calorimeter and the crystallization temperature Tc2 defined as a maximum point of an exothermic peak attributable to crystallization detected in the course of cooling from a molten state at a cooling rate of 10° C./min is not lower than 35° C., and (b) a difference (Tci−Tg) between the crystallization temperature Tci defined as a maximum point of an exothermic peak attributable to crystallization detected in the course of heating an amorphous sheet at a heating rate of 10° C./min. by means of a differential scanning calorimeter and the glass transition temperature Tg defined as a temperature at a second-order transition point on a calorimetric curve detected in said course is not lower than 40° C.

3. The tool of claim 2, wherein the hard solid-state high-molecular-weight polyglycolic acid is a semi-crystalline material having a density of between about 1.50 grams per cc and about 1.90 grams per cc.

4. The tool of claim 2, wherein the ball is capable of losing sufficient compression resistance and structural integrity to pass through the ball seat responsive to hydrostatic pressure from above the ball within less than eight hours from being pumped down the well due to the ball degrading in wellbore fluid having a temperature of at least 136° F., causing the tool to cease isolating the upper and lower zones from each other without drilling out the tool due to being degraded by exposure to the downhole fluid; and thereafter the tool is degraded within one month into environmentally non-toxic substances after being exposed to the downhole fluid having a temperature of at least 136° F., the within two months of the mandrel entering the wellbore fluid tool weighs less than 90% of its initial weight.

5. The tool of claim 1, wherein the hard solid-state high-molecular-weight polyglycolic acid is a semi-crystalline material having a density of between about 1.50 grams per cc and about 1.90 grams per cc.

6. The tool of claim 1, wherein the ball is capable of losing sufficient compression resistance and structural integrity to pass through the ball seat responsive to hydrostatic pressure from above the ball within less than eight hours from being pumped down the well due to the ball degrading in wellbore fluid having a temperature of at least 136° F., causing the tool to cease isolating the upper and lower zones from each other without drilling out the tool due to being degraded by exposure to the downhole fluid; and thereafter the tool is degraded within one month into environmentally non-toxic substances after being exposed to the downhole fluid having a temperature of at least 136° F., the within two months of the mandrel entering the wellbore fluid tool weighs less than 90% of its initial weight.

7. The tool of claim 1, further comprising a slip movable on an exterior of the mandrel from a running in position to an extended position for engaging the casing;

wherein the slip comprises an outer section comprised of teeth and an inner section;

wherein the teeth are comprised of metallic or ceramic materials; and wherein the inner section is comprised of a hard high-molecular-weight polyglycolic acid degradable material, that will begin to degrade when exposed to a downhole fluid at a temperature of at least at about 150° F. so that when used in well with downhole fluid at a temperature of at least 150° F., the inner section degrades, detaching from the teeth and degrading into smaller fragments which do not interfere with completing the well within about four days of being exposed to the downhole fluid in the wellbore and the inner section further degrades to have an 18% mass decrease within four days the inner section entering the wellbore fluid.

8. The tool of claim 7, wherein at least part of the well is vertical with a vertical depth of at least 8,000 feet and at least part of the well is horizontal with a lateral reach of at least 4,000 feet, and the tool is capable of being used in the horizontal without leaving enough debris in the horizontal to obstruct production of hydrocarbons from the well.

9. The tool of claim 7, further comprising the ball being capable of losing sufficient compression resistance and structural integrity within less than eight hours from being pumped down the well due to degrading in the wellbore fluid to pass through the ball seat, causing the tool to cease isolating the upper and lower zones from each other without drilling out the tool; and the tool is capable of losing sufficient compression resistance and structural integrity due to degrading in the wellbore fluid to mechanically fail within less than one day, releasing the tool from the casing without drilling out the tool.

10. The tool of claim 1, wherein at least part of the well is vertical with a vertical depth of at least 8,000 feet and at least part of the well is horizontal with a lateral reach of at least 4,000 feet, and the tool is capable of being used in the horizontal without leaving enough debris in the horizontal to obstruct production of hydrocarbons from the well.

11. The tool of claim 10, further comprising the ball being capable of losing sufficient compression resistance and structural integrity within less than eight hours from being pumped down the well due to degrading in the wellbore fluid to pass through the ball seat, causing the tool to cease isolating the upper and lower zones from each other without drilling out the tool; and the tool is capable of losing sufficient compression resistance and structural integrity due to degrading in the wellbore fluid to mechanically fail within less than one day, releasing the tool from the casing without drilling out the tool.

12. A settable downhole tool for use in a hydrocarbon well with production casing to engage with the production casing and temporarily isolate a zone above the tool from a zone below the tool, so the zone above the tool can be fracked in isolation from the zone below the tool, comprising:

a primary structural member, namely a mandrel, consisting essentially of hard solid-state high-molecular-weight polyglycolic acid which has at least short-term stability in ambient conditions and loses sufficient crystalline structure due to hydrolysis in the well under thermal stress of 250° F. to mechanically fail within two days and thereafter degrades in the wellbore into naturally-occurring glycerin, the tool having a ball seat; the ball seat comprised of hard solid-state high-molecular-weight polyglycolic acid; a frac ball comprised of hard solid-state high-molecular-weight polyglycolic acid and capable of being pumped from the surface to seat securely into the ball seat where the frac ball has enough hardness and crystalline structure when initially seated on the ball seat to be capable of causing the tool to isolate the zone above the tool from the zone below the tool so the zone above the tool can be fracked in isolation from the zone below the tool; the frac ball is capable of losing enough hardness and crystalline structure due to hydrolysis within less than two days from being pumped down the well to become malleable enough to pass through the ball seat responsive to hydrostatic pressure from above the ball to cause the tool to cease isolating the upper and lower zones from each other without drilling out the tool or other intervention from the surface; and the tool is capable of degrading in the wellbore through hydrolysis.

13. The tool of claim 12, wherein the hard solid-state high-molecular-weight polyglycolic acid is a semi-crystalline material having a density of between about 1.50 grams per cc and about 1.90 grams per cc.

14. The tool of claim 12 wherein the ball is capable of losing sufficient compression resistance and structural integrity to pass through the ball seat responsive to hydrostatic pressure from above the ball within less than eight hours from being pumped down the well due to the ball degrading in wellbore fluid having a temperature of at least 136° F., causing the tool to cease isolating the upper and lower zones from each other without drilling out the tool due to being degraded by exposure to the downhole fluid; and thereafter the tool is degraded within one month into environmentally non-toxic substances after being exposed to the downhole fluid having a temperature of at least 136° F., the within two months of the mandrel entering the wellbore fluid tool weighs less than 90% of its initial weight.

15. A settable downhole tool for use in a hydrocarbon well with casing to engage with the casing and temporarily isolate a zone above the tool, being an upper zone, from a zone below the tool, being a lower zone, so the upper zone can be fracked in isolation from the lower zone:

the tool is comprised of a hard solid-state high-molecular-weight polyglycolic acid prepared from at least partially crystalline polyglycolic acid, wherein:

(a) a difference (Tm−Tc2) between the melting point Tm defined as a maximum point of an endothermic peak attributable to melting of a crystal detected in the course of heating at a heating rate of 10° C./min by means of a differential scanning calorimeter and the crystallization temperature Tc2 defined as a maximum point of an exothermic peak attributable to crystallization detected in the course of cooling from a molten state at a cooling rate of 10° C./min is not lower than 35° C., and (b) a difference (Tci−Tg) between the crystallization temperature Tci defined as a maximum point of an exothermic peak attributable to crystallization detected in the course of heating an amorphous sheet at a heating rate of 10° C./min by means of a differential scanning calorimeter and the glass transition temperature Tg defined as a temperature at a second-order transition point on a calorimetric curve detected in said course is not lower than 40° C.;

the tool is capable of engaging the casing and being used in a hydraulic fracking operation as a conventional such tool to frac the upper zone in isolation from the lower zone;

the tool is capable of ceasing to isolate the upper and lower zones from each other without drilling out the tool within less than two days from being pumped down the well due to a member of the tool degrading in the wellbore fluid;

the tool is capable of mechanically failing and ceasing to engage the casing without drilling out the tool within less than two days from being pumped down the well due to a member of the tool degrading in the wellbore fluid; and the tool is capable of degrading in the wellbore fluid enough so the tool does not obstruct production of hydrocarbons from the well without drilling out the tool.

16. The tool of claim 15, wherein at least part of the well is vertical with a vertical depth of at least 8,000 feet and at least part of the well is horizontal with a lateral reach of at least 4,000 feet, and the tool is capable of being used in the horizontal without leaving enough debris in the horizontal to obstruct production of hydrocarbons from the well.

17. The tool of claim 16, further comprising:

a mandrel, ball seat and frac ball, the mandrel having an inner passage, the ball seat located at an end of the passage, and the ball comprised of hard solid-state high-molecular-weight polyglycolic acid capable of being pumped down the well from the surface with a wellbore fluid, without an appreciable effect on the ball's short-term hardness, the ball capable of seating securely into the ball seat to block the passage;

the ball in the ball seat having sufficient compression resistance and structural integrity to be capable of causing the tool to isolate the upper zone from the lower zone so the upper zone can be fracked in isolation from the lower zone;

the ball is capable of losing sufficient compression resistance and structural integrity within less than two days from being pumped down the well due to degrading in the wellbore fluid to pass through the ball seat responsive to hydrostatic pressure from above the ball, causing the tool to cease isolating the upper and lower zones from each other without drilling out the tool; and the ball is capable of degrading in the wellbore fluid enough to not obstruct production of hydrocarbons from the well without being drilled out, and the degradation products are not harmful to the environment, one of the degradation products being glycerin.

18. The tool of claim 15, further comprising:

a mandrel, ball seat and frac ball, the mandrel having an inner passage, the ball seat located at an end of the passage, and the ball comprised of hard solid-state high-molecular-weight polyglycolic acid capable of being pumped down the well from the surface with a wellbore fluid, without an appreciable effect on the ball's short-term hardness, the ball capable of seating securely into the ball seat to block the passage;

the ball in the ball seat having sufficient compression resistance and structural integrity to be capable of causing the tool to isolate the upper zone from the lower zone so the upper zone can be fracked in isolation from the lower zone;

the ball is capable of losing sufficient compression resistance and structural integrity within less than two days from being pumped down the well due to degrading in the wellbore fluid to pass through the ball seat responsive to hydrostatic pressure from above the ball, causing the tool to cease isolating the upper and lower zones from each other without drilling out the tool; and the ball is capable of degrading in the wellbore fluid enough to not obstruct production of hydrocarbons from the well without being drilled out, and the degradation products are not harmful to the environment, one of the degradation products being glycerin.

19. The tool of claim 15, further comprising a flapper valve engaging the mandrel and moveable between a first operative position allowing upward and downward flow through the tool and a second operative position allowing upward flow through the tool and preventing downward flow through the tool, the flapper valve being comprised of a hard high-molecular weight semi-crystalline polyglycolic acid which is degradable in the wellbore fluid at temperatures above about 150° F. within about 4 days of the tool being exposed to the downhole fluid.

20. The tool of claim 15, further comprising a upward facing dome shaped disk engaging the mandrel and blocking downward flow of fluid through the tool, the disk being convex from an upward perspective and comprised of a hard high-molecular weight semi-crystalline polyglycolic acid which is degradable in the downhole fluid at temperatures above about 150° F. within about 4 days of the tool being exposed to the downhole fluid.

21. A set of multiple settable downhole isolation tools for use in a horizontal leg of a hydrocarbon well with casing to sequentially frac multiple zones in the horizontal leg, wherein at least part of the well is vertical with a vertical depth of at least 8,000 feet and at least part of the well is horizontal with a lateral reach of at least 4,000 feet, the well having a downhole fluid, comprising:

a first tool comprised of hard solid-state high-molecular-weight polyglycolic acid which has at least short-term stability in ambient conditions, capable of being run into the horizontal leg, expanded into engagement with the casing in the horizontal leg, and isolating a zone above the first tool, being a first upper zone, from a zone below the first tool, being a first lower zone, to permit the first upper zone to be fracked in isolation from the first lower zone;

a second tool comprised of hard solid-state high-molecular-weight polyglycolic acid capable of being run into the horizontal leg, expanded into engagement with the casing in the horizontal leg, and isolating a zone above the second tool, being a second upper zone, from a zone below the second tool, being a second lower zone, to permit the second upper zone to be fracked in isolation from the second lower zone; and a third tool comprised of hard solid-state high-molecular-weight polyglycolic acid capable of being run into the horizontal leg, expanded into engagement with the casing in the horizontal leg, and isolating a zone above the third tool, being third upper zone, from a zone below the third tool, being third lower zone, to permit the third upper zone to be fracked in isolation from the third lower zone;

each of the tools is capable of ceasing to isolate its upper and lower zones from each other without drilling out the tool within less than eight hours from being pumped down the well due to a member of the tool degrading in the wellbore fluid;

each of the tools is capable of mechanically failing and ceasing to engage the casing without drilling out the tool within less than two days from being pumped down the well due to a member of the tool degrading in the wellbore fluid; and each of the tools is capable of degrading in the downhole fluid within one month of being run into the well, degradation of the tools causing the tools to have less than 90% of their original weight within one month after entry into the downhole fluid, and the set of tools is capable of being used in the horizontal leg e€-a of a hydrocarbon well to sequentially frac multiple zones in the horizontal leg without leaving enough debris in the horizontal leg to obstruct production of hydrocarbons from the fracked zones in the horizontal leg and without drilling out the tools.

22. The tool of claim 21, wherein the hard solid-state high-molecular-weight polyglycolic acid is a semi-crystalline material having a density of between about 1.50 grams per cc and about 1.90 grams per cc.

23. The tool of claim 21, wherein the ball is capable of losing sufficient compression resistance and structural integrity to pass through the ball seat responsive to hydrostatic pressure from above the ball within less than eight hours from being pumped down the well due to the ball degrading in wellbore fluid having a temperature of at least 136° F., causing the tool to cease isolating the upper and lower zones from each other without drilling out the tool due to being degraded by exposure to the downhole fluid; and thereafter the tool is degraded within one month into environmentally non-toxic substances after being exposed to the downhole fluid having a temperature of at least 136° F., the within two months of the mandrel entering the wellbore fluid tool weighs less than 90% of its initial weight.

* * * * *